US009885525B2

(12) United States Patent
Yokozeki et al.

(10) Patent No.: US 9,885,525 B2
(45) Date of Patent: Feb. 6, 2018

(54) AFT CONDITIONER

(71) Applicant: Johnson Controls-Hitachi Air Conditioning Technology (Hong Kong) Limited, Kowloon Bay KLN (HK)

(72) Inventors: Atsuhiko Yokozeki, Tokyo (JP); Shuuhei Tada, Tokyo (JP); Hiroaki Tsuboe, Tokyo (JP)

(73) Assignee: Johnson Controls-Hitachi Air Conditioning Technology (Hong Kong) Limited, Kowloon Bay KLN (HK)

( * ) Notice: Subject to any disclaimer, the term of this patent is extended or adjusted under 35 U.S.C. 154(b) by 276 days.

(21) Appl. No.: 14/607,634

(22) Filed: Jan. 28, 2015

(65) Prior Publication Data

US 2015/0211802 A1 Jul. 30, 2015

(30) Foreign Application Priority Data

Jan. 29, 2014 (JP) ..... 2014-014858

(51) Int. Cl.
*F28F 1/32* (2006.01)
*F24F 1/00* (2011.01)
(Continued)

(52) U.S. Cl.
CPC ..... *F28F 1/325* (2013.01); *F24F 1/0007* (2013.01); *F24F 1/0059* (2013.01); *F25B 13/00* (2013.01);
(Continued)

(58) Field of Classification Search
CPC ..... F24F 2001/0037; F24F 1/0007; F24F 1/0059; F28F 1/325; F28F 9/0275;
(Continued)

(56) References Cited

U.S. PATENT DOCUMENTS 4,995,453 A * 2/1991 Bartlett ..... F25B 39/00 165/150
5,076,353 A * 12/1991 Haussmann ..... F25B 39/04 165/110
(Continued)

FOREIGN PATENT DOCUMENTS

CN 100533007 C 8/2009
CN 102639954 A 8/2012
(Continued)

OTHER PUBLICATIONS

Japanese-language Office Action issued in counterpart Japanese Application No. 2014-014858 dated Feb. 21, 2017 with English translation (9 pages).
(Continued)

*Primary Examiner* — Tho V Duong
(74) *Attorney, Agent, or Firm* — Crowell & Moring LLP

(57) ABSTRACT

Heat transfer pipes **26*b*1 and 26*b*2 extend from the other end section 21B to one end section 21A in an intermediate row L2 and combine in the one end section 21A to be heat transfer pipes 26*c*1 and 26*c*2. The heat transfer pipes 26*c*1 and 26*c*2 are configured to extend back and force once between the one end section 21A and the other end section 21B in a upstream row L1. Heat transfer pipes 26*b*3 and 26*b*4 extend from the other end section 21B to the one end section 21A in the intermediate row L2 and combine in the one end section 21A to be heat transfer pipes 26*c*3 and 26*c*4. The heat transfer pipes 26*c*3 and 26*c*4 are configured to extend back and force once between the one end section 21A and the other end section 21B in the upstream row L1. The heat transfer pipe 26*c*2 extending from the other end section 21B to the one end section 21A and the heat transfer pipe 26*c*4 from the other end section 21B to the one end section 21**A are arranged to be adjacent to each other.

9 Claims, 20 Drawing Sheets

(51) Int. Cl.

| | |
|---|---|
| ***F28D 1/047*** | (2006.01) |
| ***F28D 1/02*** | (2006.01) |
| ***F28F 9/02*** | (2006.01) |
| ***F25B 13/00*** | (2006.01) |
| ***F25B 39/02*** | (2006.01) |
| *F28D 21/00* | (2006.01) |

(52) U.S. Cl.
CPC ..... *F25B 39/028* (2013.01); *F28D 1/024* (2013.01); *F28D 1/047* (2013.01); *F28D 1/0475* (2013.01); *F28F 9/0275* (2013.01); *F25B 2313/006* (2013.01); *F28D 2021/007* (2013.01); *F28D 2021/0071* (2013.01)

(58) Field of Classification Search
CPC ..... F28D 1/047; F28D 1/0475; F28D 1/0426; F28D 2021/007; F28D 2021/0071; F28D 1/024; F25B 39/04; F25B 13/00; F25B 39/028; F25B 2313/006
See application file for complete search history.

(56) References Cited

U.S. PATENT DOCUMENTS

| | | | | |
|---|---|---|---|---|
| 5,219,023 | A * | 6/1993 | Kadle | B60H 1/3227 165/110 |
| 6,142,220 | A * | 11/2000 | Motegi | F28F 1/325 165/110 |
| 2010/0205993 | A1 | 8/2010 | Matsuda et al. | |
| 2012/0073786 | A1* | 3/2012 | Sakashita | F24F 1/0007 165/104.14 |
| 2012/0145364 | A1 | 6/2012 | Oritani et al. | |
| 2012/0318487 | A1* | 12/2012 | Kikuchi | F24F 1/0007 165/173 |

FOREIGN PATENT DOCUMENTS

| | | | |
|---|---|---|---|
| EP | 2 578 966 | A1 | 4/2013 |
| JP | 8-75316 | A | 3/1996 |
| JP | 2000-274982 | A | 10/2000 |
| JP | 2009-198055 | A | 9/2009 |
| JP | 2010-78287 | A | 4/2010 |
| JP | 2010-281548 | A | 12/2010 |
| JP | 2011-122819 | A | 6/2011 |
| WO | WO 2011/148567 | A1 | 12/2011 |

OTHER PUBLICATIONS

Chinese-language Office Action issued in counterpart Chinese Application No. 201510043340.7 dated Feb. 3, 2017 with English translation (15 pages).

* cited by examiner

AFT CONDITIONER

TECHNICAL FIELD

The present invention relates to an air conditioner including a high-efficiency heat exchanger.

BACKGROUND

In a heat exchanger of an air conditioner, a refrigerant flow rate in a heat transfer pipe is optimized to adjust a balance between a pressure loss on a refrigerant side and a heat transfer coefficient, and improve the performance of the heat exchanger. That is, the heat exchanger is designed taking into account the channel inner diameter of the heat transfer pipe and the number of refrigerant channels in order to exhibit the heat exchanger performance.

It is proposed that, in a heat exchanger in which heat transfer pipes are arranged in three rows, a heat transfer pipe diameter D1 on the most windward side is set the smallest in a range of D1=3 to 4 mm and a relation among the heat transfer pipe diameter D1, a heat transfer pipe diameter D2 in the middle, and a downwind side heat transfer pipe diameter D3 is set as D1<D2=D3, 4 mm≤D3≤10 mm, and 0.6≤D1/D2<1 (see, for example, Japanese Patent Application Publication No. 2011-122819). This configuration improves heat exchange performance while suppressing an increase in a pressure loss.

It is also proposed that a heat transfer pipe of a fin connected to a liquid side distributor or a gas side distributor extends back and forth once and is divided and connected to two heat transfer pipes of an adjacent fin and one path of the heat transfer pipe is configured by extending back and forth twice (see, for example, Japanese Patent Application Publication No. 2010-78287). This configuration increases a flow rate on the liquid side. Consequently, the pressure loss in the heat transfer pipe increases and, on the other hand, a surface heat transfer coefficient is improved.

SUMMARY

However, in the configuration described in Japanese Patent Application Publication No. 2011-122819, a different manufacturing apparatus is necessary for each of heat transfer pipes having different diameter. Therefore, manufacturing man-hours for the heat exchanger increases. Further, a heat transfer area on the heat transfer pipe inner side decreases in a row on the windward side where the thin-diameter heat transfer pipe is arranged. The overall performance of the heat exchanger is deteriorated.

When the heat exchanger disclosed in Japanese Patent Application Publication No. 2010-78287 acts as a condenser, according to a temperature change in an subcooling region, heat conduction through the fin affects between the heat transfer pipes vertically adjacent to each other and internal heat exchange occurs. Consequently, a heat loss in the subcooling region occurs.

The present invention has been devised in view of the problems explained above and it is an object of the present invention to provide an air conditioner including a high-performance heat exchanger.

In order to attain the above and other objects, there is provided an air conditioner includes a heat exchanger that includes a plurality of heat transfer pipes, through which a refrigerant flows, and performs heat exchange with air. The heat exchanger includes one end section and the other end section. The plurality of heat transfer pipes are disposed to extend back and force between the one end section and the other end section in a state in which the heat transfer pipes are arranged in a direction crossing a direction in which the air flows, and rows of the plurality of heat transfer pipes arranged in the crossing direction are configured to be arranged in at least two rows along the direction in which the air flows. The two rows include a first row located most upstream in the direction in which the air flows and a second row located adjacent to the first row in the direction in which the air flows. The plurality of heat transfer pipes include a first heat transfer pipe and a second heat transfer pipe adjacent to each other in the second row, the first heat transfer pipe and the second heat transfer pipe extend from the other end section to the one end section in the second row and are combined in the one end section to be a first combined pipe, and the first combined pipe is configured to extend back and force once between the one end section and the other end section in the first row. The plurality of heat transfer pipes further include a third heat transfer pipe and a fourth heat transfer pipe adjacent to each other in the second row, the third heat transfer pipe and the forth heat transfer pipe are arranged to be adjacent to the first heat transfer pipe and the second heat transfer pipe and respectively extend from the other end section to the one end section in the second row, and are combined in the one end section to be a second combined pipe, and the second combined pipe is configured to extend back and force between the one end section and the other end section in the first row. A portion extending from the other end section to the one end section in the first combined pipe and a portion extending from the other end section to the one end section in the second combined pipe are arranged to be adjacent to each other.

In another aspect of the present invention, there is provided an air conditioner includes a heat exchanger that includes a plurality of heat transfer pipes, through which a refrigerant flows, and performs heat exchange with air. The heat exchanger includes one end section and the other end section. The plurality of heat transfer pipes are disposed to extend back and force between the one end section and the other end section in a state in which the heat transfer pipes are arranged in a direction crossing a direction in which the air flows, and rows of the plurality of heat transfer pipes arranged in the crossing direction are configured to be arranged in at least two rows along the direction in which the air flows. The two rows include a first row located most upstream in the direction in which the air flows and a second row located adjacent to the first row in the direction in which the air flows. The plurality of heat transfer pipes include a first heat transfer pipe and a second heat transfer pipe adjacent to each other in the second row, the first heat transfer pipe and the second heat transfer pipe extend from the other end section to the one end section in the second row and are combined in the one end section to be a first combined pipe, and the first combined pipe is configured to extend back and force once between the one end section and the other end section in the first row. The refrigerant is R32 or a refrigerant containing 70 wt. % or more of R32.

According to the present invention, an air conditioner including a high-performance heat exchanger can be provided.

DESCRIPTION OF EMBODIMENTS

Figure 1:
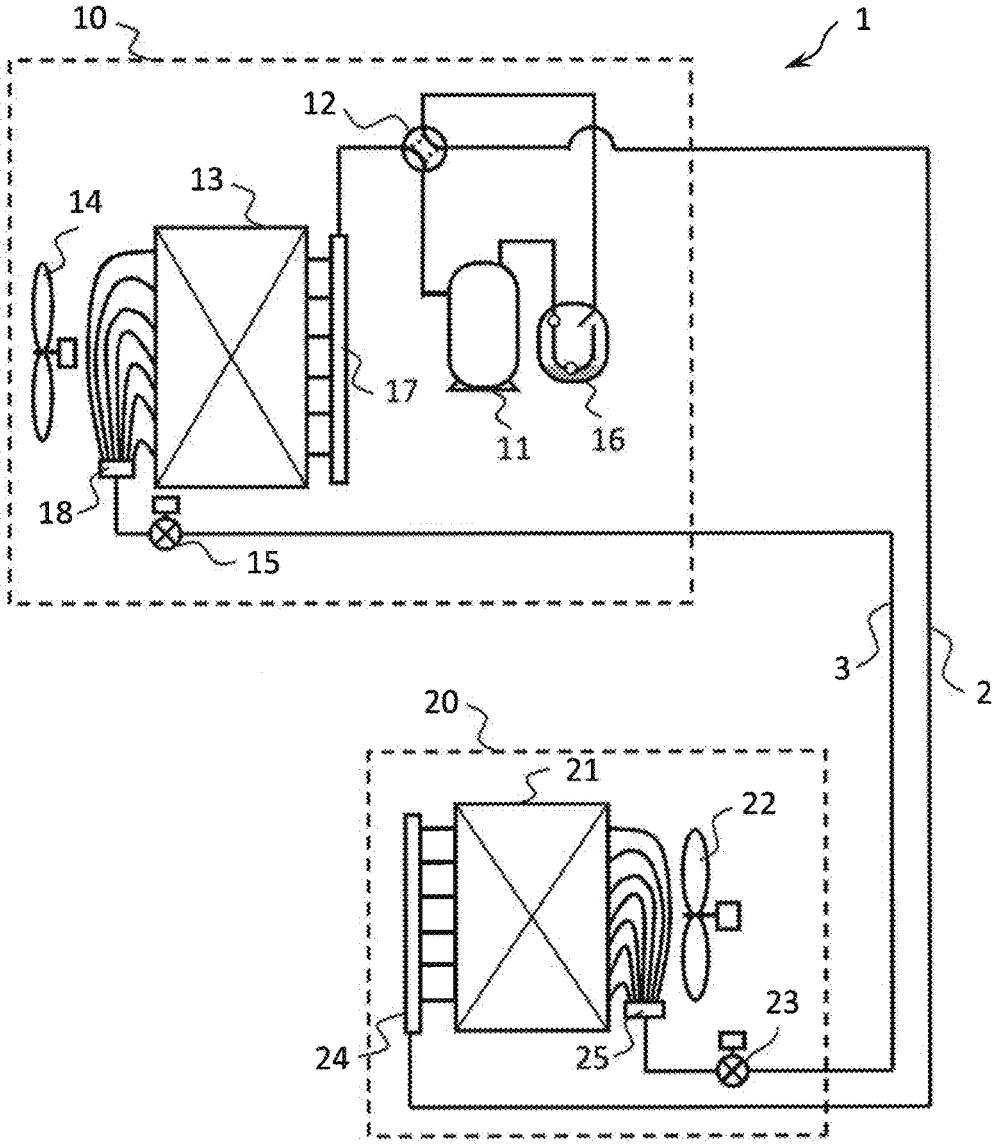
FIG. 1 shows a refrigeration cycle of an air conditioner according to the present invention.

An air conditioner according to an embodiment of the present invention is explained below with reference to the drawings. FIG. 1 shows a refrigeration cycle of an air conditioner 1 according to the embodiment of the present invention.

The air conditioner 1 includes an outdoor unit 10 and an indoor unit 20. The outdoor unit 10 and the indoor unit 20 are connected by a gas connection pipe 2 and a liquid connection pipe 3. In this embodiment, the outdoor unit 10 and the indoor unit 20 are connected in a one-to-one relation. However, a plurality of outdoor units may be connected to one indoor unit. A plurality of indoor units may be connected to one outdoor unit.

The outdoor unit 10 includes a compressor 11, a four-way valve 12, an outdoor heat exchanger 13, an outdoor fan 14, an outdoor expansion valve 15, and an accumulator 16. In the outdoor heat exchanger 13, an outdoor gas side refrigerant distributor 17 and an outdoor liquid side refrigerant distributor 18 are provided.

The compressor 11 compresses a refrigerant and discharges the refrigerant to a pipe. When the four-way valve is switched, a flow of the refrigerant changes and a cooling operation and a heating operation are switched. The outdoor heat exchanger 13 performs heat exchange between the refrigerant and the outdoor air. The outdoor fan 14 supplies the outdoor air to the outdoor heat exchanger 13. The outdoor expansion valve 15 decompresses and cools the refrigerant. The accumulator 16 is provided in order to store returned liquid during transition. The accumulator 16 adjusts the refrigerant to a moderate vapour quality.

The indoor unit 20 includes an indoor heat exchanger 21, an indoor fan 22, and an indoor expansion valve 23. The indoor heat exchanger 21 performs heat exchange between the refrigerant and the indoor air. The indoor fan 22 supplies the indoor air to the indoor heat exchanger 21. The indoor expansion valve 23 is capable of changing a flow rate of the refrigerant flowing through the indoor heat exchanger 21 by changing a throttle amount of the indoor expansion valve 23. In the indoor heat exchanger 21, an indoor gas side refrigerant distributor 24 and an indoor liquid side refrigerant distributor 25 are provided.

In the air conditioner 1 in this embodiment, as a refrigerant encapsulated in the refrigeration cycle and acting to transport thermal energy during a cooling operation and during a heating operation, a refrigerant containing R32 alone (100 wt. %) or a mixed refrigerant containing 70 weight % or more of R32 is used.

The operation of the refrigeration cycle of the air conditioner 1 is explained.

First, a cooling operation in the air conditioner 1 is explained. In the cooling operation, as indicated by a solid line, the four-way valve 12 causes a discharge side of the compressor 11 and the outdoor heat exchanger 13 to communicate with each other and causes a suction side of the compressor 11 and the gas connection pipe 2 to communicate with each other.

A high-temperature and high-pressure gas refrigerant discharged from the compressor 11 flows into the outdoor heat exchanger 13 through the four-way valve 12. The high-temperature and high-pressure gas refrigerant flown into the outdoor heat exchanger 13 exchanges heat with the outdoor air supplied by the outdoor fan 14, condenses, and changes to a liquid refrigerant. The liquid refrigerant passes through the outdoor expansion valve 15 and the liquid connection pipe 3 and flows into the indoor unit 20. The liquid refrigerant flown into the indoor unit 20 is decompressed by the indoor expansion valve 23 to change to a low-temperature and low-pressure gas-liquid mixed refrigerant. The low-temperature and low-pressure refrigerant flows into the indoor heat exchanger 21, exchanges heat with the indoor air supplied by the indoor fan 22, evaporates, and changes to a gas refrigerant. In this case, the indoor air is cooled by latent heat of evaporation of the refrigerant. Cold wind is sent into a room. Thereafter, the gas refrigerant is returned to the outdoor unit 10 through the gas connection pipe 2.

The gas refrigerant returned to the outdoor unit 10 passes through the four-way valve 12 and the accumulator 16 and is sucked by the compressor 11 and compressed by the compressor 11 again, whereby a series of refrigeration cycle is formed.

A heating operation in the air conditioner 1 is explained. In the heating operation, as indicated by a dotted line, the four-way valve 12 causes the discharge side of the compressor 11 and the gas connection pipe 2 to communicate with each other and causes the suction side of the compressor 11 and the outdoor heat exchanger 13 to communicate with each other.

A high-temperature and high-pressure gas refrigerant discharged from the compressor 11 is sent to the gas connection pipe 2 through the four-way valve 12 and flows into the indoor heat exchanger 21 of the indoor unit 20. The high-temperature and high-pressure gas refrigerant flown into the indoor heat exchanger 21 exchanges heat with the indoor air supplied by the indoor fan 22, condenses, and changes to a high-pressure liquid refrigerant. In this case, the indoor air is heated by the refrigerant. Hot air is sent into the room. Thereafter, a liquidized refrigerant passes through the indoor expansion valve 23 and the liquid connection pipe 3 and is returned to the outdoor unit 10.

The liquid refrigerant returned to the outdoor unit 10 is decompressed by the outdoor expansion valve 15 to change a low-temperature and low-pressure gas-liquid mixed refrigerant. The decompressed refrigerant flows into the outdoor heat exchanger 13, exchanges heat with the outdoor air supplied by the outdoor fan 14, evaporates, and changes to a low-pressure gas refrigerant. The gas refrigerant flown out from the outdoor heat exchanger 13 passes through the four-way valve 12 and the accumulator 16 and is sucked by the compressor 11 and compressed by the compressor 11 again, whereby a series of refrigeration cycle is formed.

Figure 2:
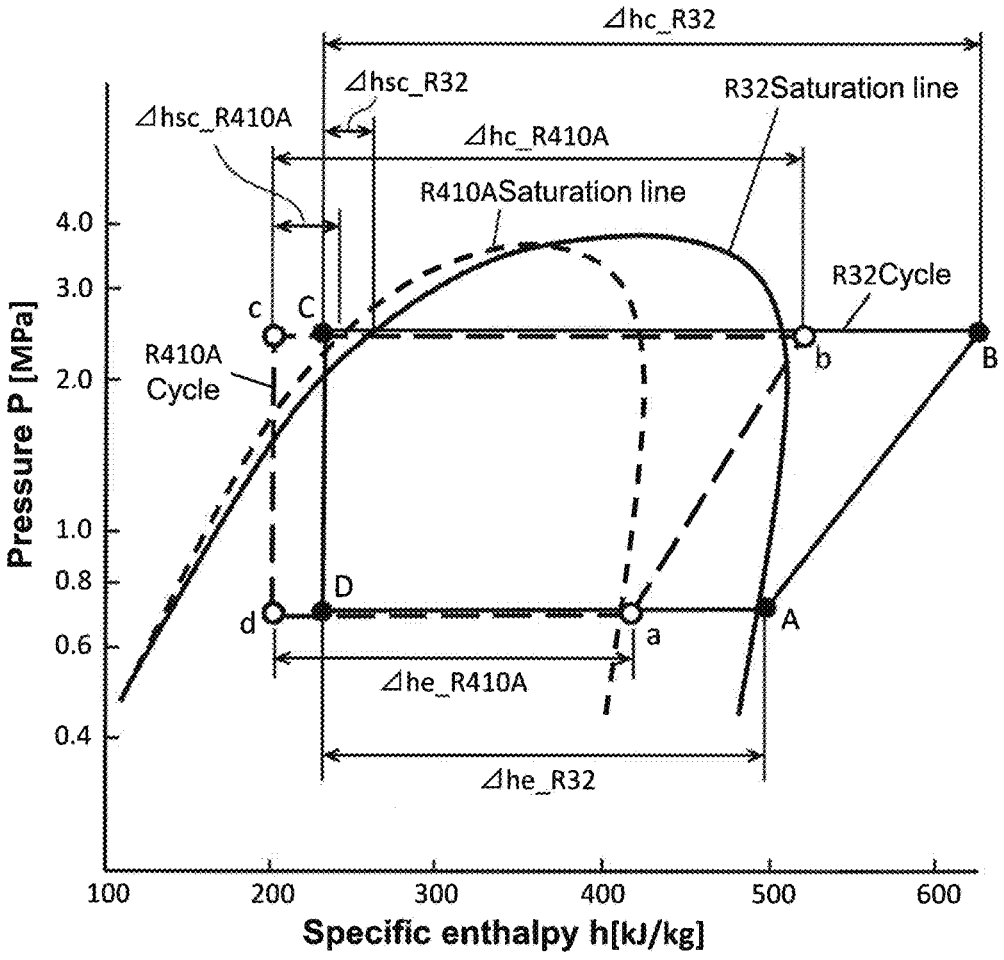
FIG. 2 is a diagram in which refrigeration cycles during a heating operation performed respectively using R410A and R32 a refrigerant are shown on a Mollier chart.

Characteristics of R32 used in the air conditioner in this embodiment are explained. Specifically, a difference in use of R32 and R410A due to a difference in refrigerant physical properties of R32 and R410A is explained. FIG. 2 is a diagram in which refrigeration cycles during a heating operation performed respectively using R410A (dashed line) and R32 (solid line) as a refrigerant are shown on a Mollier chart. Note that R410A is a conventionally used refrigerant and is a refrigerant having a high GWP (global warming potential) compared with R32.

R32 has a characteristic that latent heat of evaporation is large compared with R410A. Therefore, a specific enthalpy difference in an evaporator or a condenser indicated by $\Delta he_R32$ and $\Delta hc_R32$ of R32 is larger than $\Delta he_R410A$ and $\Delta hc_R410A$ of R410A. Therefore, a refrigerant mass flow rate of R32 necessary for generation of the same ability can be set smaller than the refrigerant mass flow rate of R410A.

$\Delta he$ indicates a specific enthalpy difference in the evaporator. $\Delta he$ indicates a specific enthalpy difference in the condenser. Suffices _R410A and _R32 respectively indicate states in the refrigerants R410A and R32.

When R32 is used as the refrigerant, a refrigerant mass flow rate can be reduced. Therefore, a pressure loss in passage of the refrigerant through channels of the heat exchangers 13 and 21 decreases and a differential pressure between high pressure and low pressure decreases. Therefore, it is possible to reduce necessary compression power in the compressor 11. There is an effect of improving a coefficient of performance (COP) of the air conditioner 1. On the other hand, according to a decrease in a refrigerant flow rate in heat transfer pipes of the heat exchangers 13 and 21, in some case, a decrease in a surface heat transfer coefficient on the refrigerant side occurs and deterioration in efficiency of the heat exchangers 13 and 21 occurs.

Figure 3:
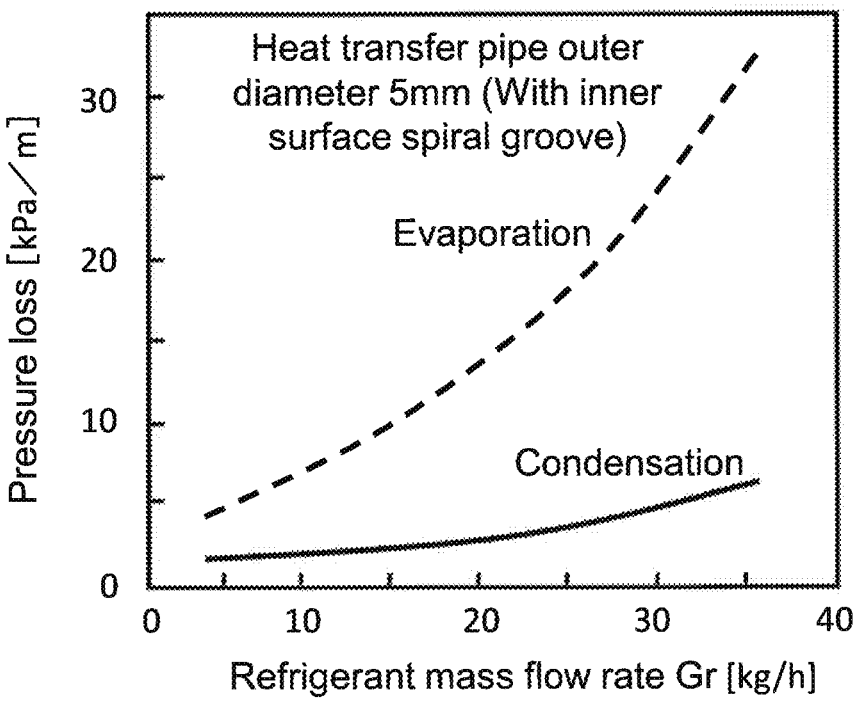
FIG. 3 is a diagram showing the influence of a refrigerant mass flow rate on a pr sure loss of a heat transfer pipe.
Figure 4:
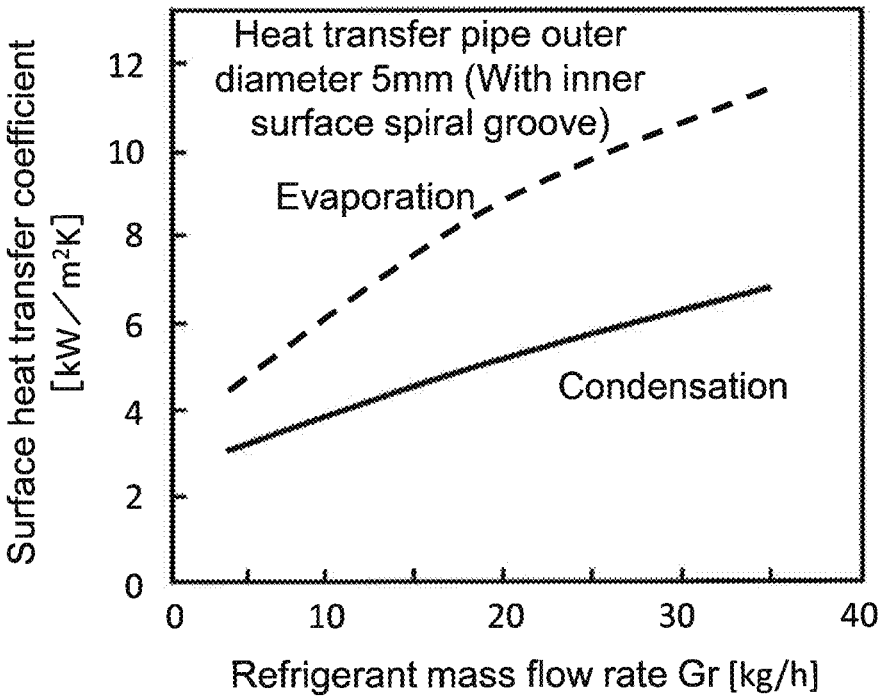
FIG. 4 is a diagram showing the influence of the refrigerant mass flow rate on a surface heat transfer coefficient of the heat transfer pipe.

FIG. 3 is a diagram showing the influence of a refrigerant mass flow rate on a pressure loss of a heat transfer pipe. FIG. 4 is a diagram showing the influence of the refrigerant mass flow rate on a surface heat transfer coefficient of the heat transfer pipe.

As shown in FIGS. 3 and 4, the pressure loss is relatively smaller when R32 is used in the condenser rather than in the evaporator. Therefore, in the air conditioner 1 in which cooling and heating are switched and used, it is necessary to set a refrigerant mass flow rate per one channel (one heat transfer pipe 26 (FIG. 7)) of the heat exchangers 13 and 21 to a flow rate well-balanced in both of the cooling and the heating.

In order to adjust the refrigerant mass flow rate per one channel of the heat exchangers 13 and 21, for example, the indoor gas side refrigerant distributor 24 and the indoor liquid side refrigerant distributor 25 (FIG. 7) are used in a refrigerant inlet of the indoor heat exchanger 21. The refrigerant is distributed to a plurality of channels (a plurality of heat transfer pipes 26) from the distributors 24 and 25 and circulates in the indoor heat exchanger 21.

Figure 5:
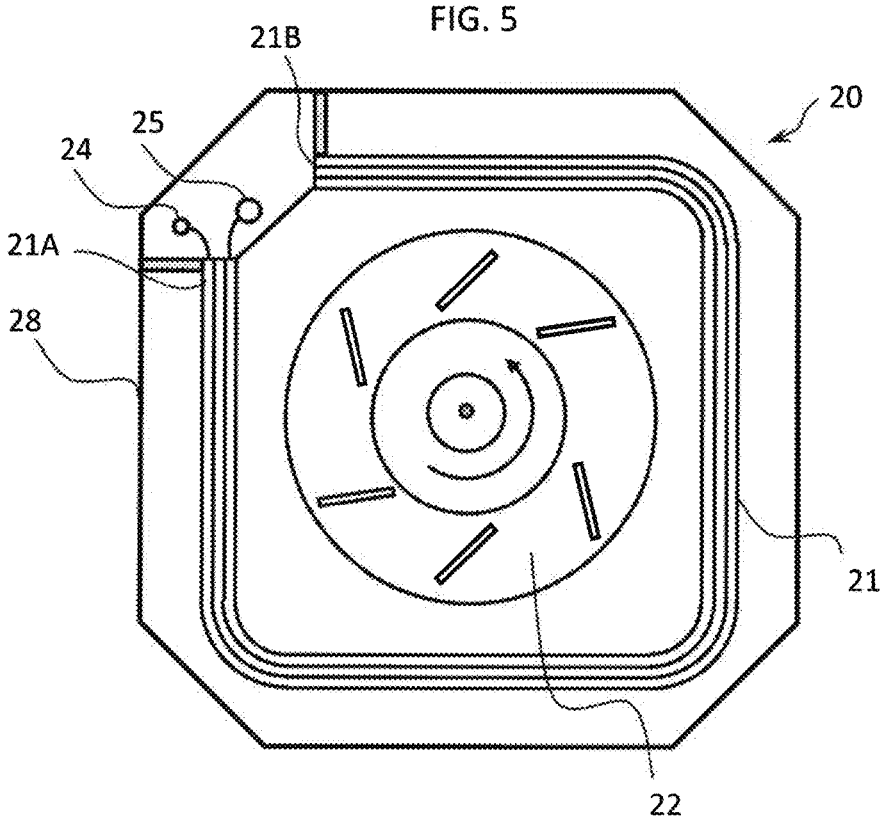
FIG. 5 is a cross sectional view of an indoor unit of a ceiling embedded type.
Figure 6:
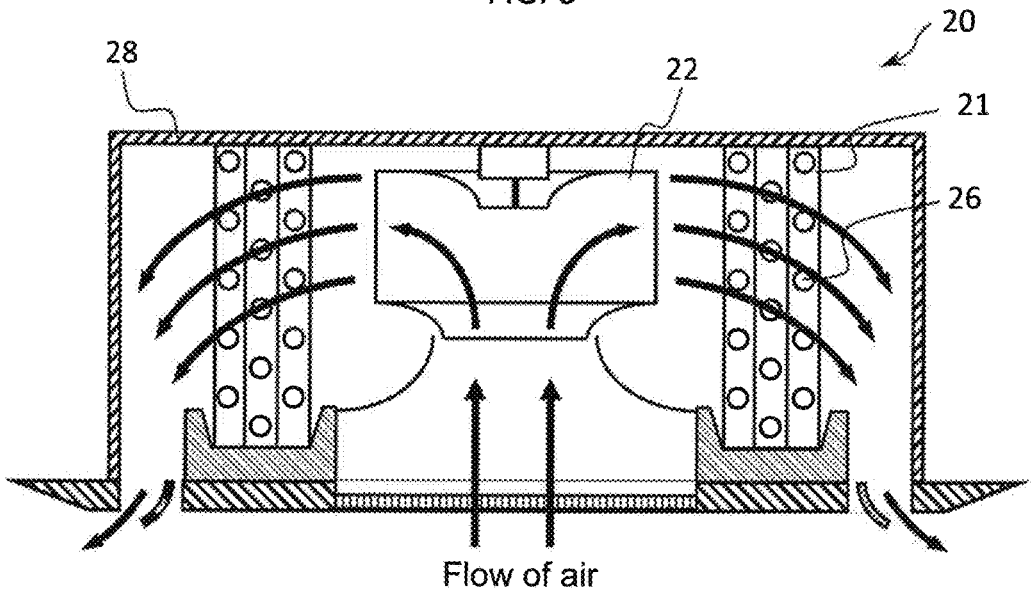
FIG. 6 is a longitudinal sectional view of the indoor unit of the ceiling embedded type.

The configuration of the indoor unit 20 of a four-way blowout ceiling embedded type in this embodiment is explained in detail. FIG. 5 shows a cross section of the indoor unit 20 of the air conditioner 1. FIG. 6 shows a longitudinal section of the indoor unit 20.

As shown in FIGS. 5 and 6, the indoor heat exchanger 21 and the indoor fan 22 are housed in a housing 28 of the indoor unit 20. The indoor heat exchanger 21 is arranged to surround the indoor fan 22. In this way, the indoor unit 20 in this embodiment is an indoor unit of the four-way blowout ceiling embedded type.

As shown in FIG. 5, the indoor heat exchanger 21 is formed in a shape (a substantially square shape) substantially entirely surrounding the indoor fan 22. The indoor heat exchanger 21 includes one end section 21A and the other end section 21B. Therefore, since the indoor heat exchanger 21 is long, when a channel of the indoor heat exchanger 21 is divided into a plurality of channels, the channel can be divided and combined only at both ends of the indoor heat exchanger 21. Therefore, the channel division is variously limited. The indoor gas side refrigerant distributor 24 and the indoor liquid side refrigerant distributor 25 are connected to the one end section 21A of the indoor heat exchanger 21.

As shown in FIG. 6, the air introduced from the room by the indoor fan 22 performs heat exchange in the indoor heat exchanger 21 and is sent into the room from a blowout port.

Figure 7:
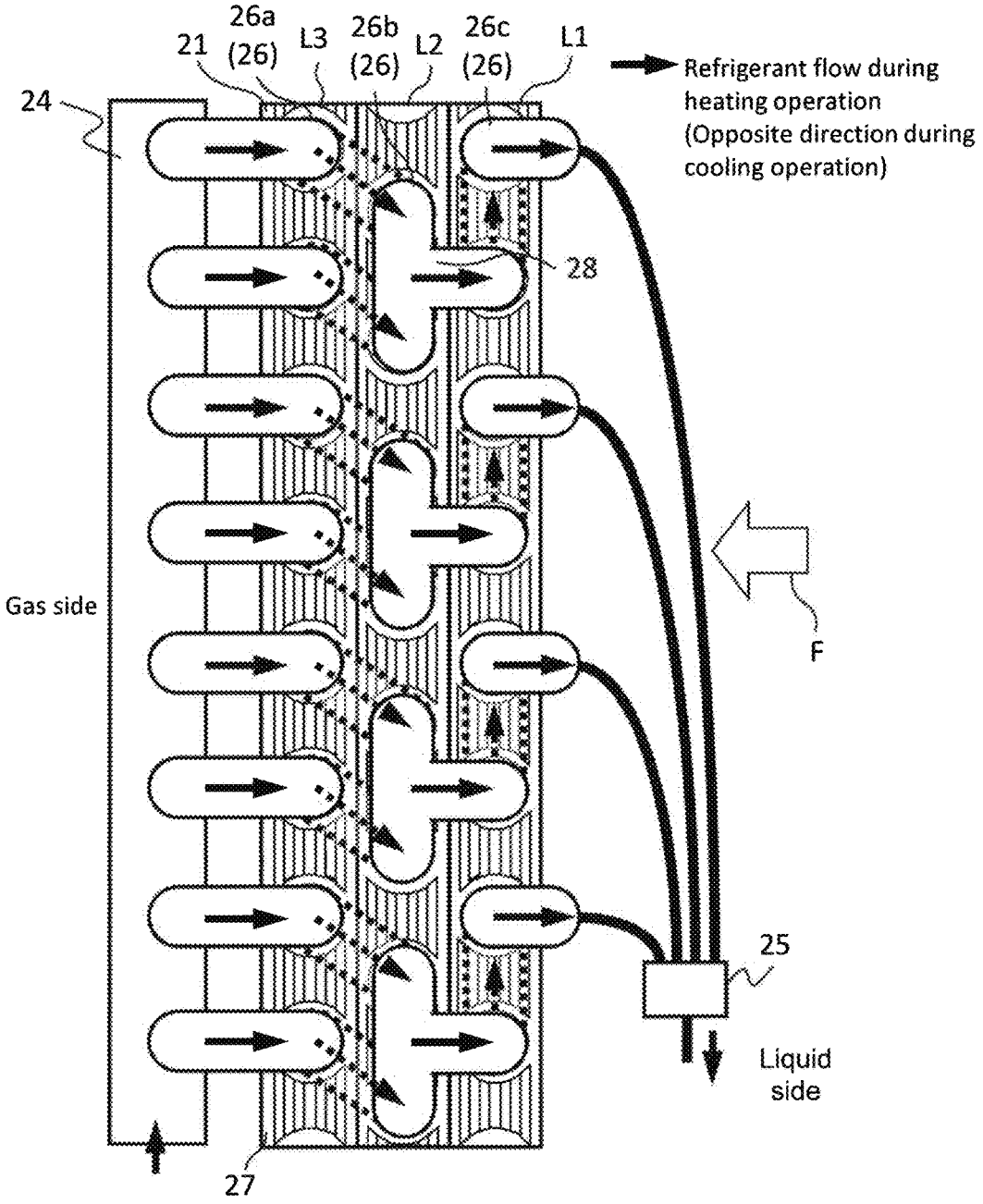
FIG. 7 is a diagram showing the configurations of heat transfer pipes and fins of an indoor heat exchanger.

FIG. 7 shows the configurations of the heat transfer pipes 26 and fins 27 of the indoor heat exchanger 21 in this embodiment. Arrows in FIG. 7 indicate flows of the refrigerant flowing through the heat transfer pipes 26 during the heating operation. As shown in FIG. 7, a plurality of heat transfer pipes 26 are inserted through a plurality of tabular fins 27 made of metal. The plurality of heat transfer pipes 26 have a row configuration including three rows along an air current direction F of the indoor air by the indoor fan 22. Each of the rows is formed by arranging the plurality of heat transfer pipes 26 in a direction crossing the air current direction F.

Since the heat transfer pipes 26 are configured in the three rows, when the indoor heat exchanger 21 acts as a condenser, if a refrigerant passage is configured in a direction opposed to a flow of the air, it is possible to keep a temperature difference from the sucked air relatively uniform. The fins of the heat exchanger can be divided for each of different refrigerant temperature levels in an subcooling region, a saturation region, and an superheating region substantially in a first row, a second row, and a third row with respect to the air flow. Therefore, the configuration is superior in heat transfer performance and is also superior in terms of ventilation performance and a mounting space.

The row configuration includes an upstream row (a first row) L1 located most upstream in the air current direction F, a downstream row (a third row) L3 located most downstream in the air current direction F, and an intermediate row (a second row) L2 located between the upstream row L1 and the downstream row L3. The heat transfer pipes configuring the downstream row L3 are referred to as heat transfer pipes 26*a*, the heat transfer pipes configuring the intermediate row L2 are referred to as heat transfer pipes 26*b*, and the heat transfer pipes configuring the upstream row L1 are referred to as heat transfer pipes 26*c*. Note that, in the rows L1 to L3, the heat transfer pipes 26 are arranged in one row in the up-down direction.

The heat transfer pipes 26*c* configuring the upstream row L1 are connected to the indoor liquid side refrigerant distributor 25. The heat transfer pipes 26*a* configuring the downstream row L3 are connected to the indoor gas side refrigerant distributor 24. The heat transfer pipes 26*a* of the downstream row L3 extend from the one end section 21A to the other end section 21B of the indoor heat exchanger 21, make a U-turn in the other end section 21B, and return to the one end section 21A of the indoor heat exchanger 21 in the intermediate row L2. In the one end section 21A of the indoor heat exchanger 21, two heat transfer pipes 26*b* adjacent to each other in the intermediate row L2 combine. One combined heat transfer pipe 26*c* extends in the upstream row L1 to extend back and force once between the one end section 21A and the other end section 21B. The heat transfer pipe 26*c* returned to the one end section 21A is connected to the indoor liquid side refrigerant distributor 25.

In other words, the heat transfer pipe 26 (the first heat transfer pipe) extends from the one end section 21A to the other end section 21B of the indoor heat exchanger in the downstream row (the third row) L3, extends from the other end section 21B to the one end section 21A of the indoor heat exchanger 21 in the intermediate row (the second row) L2, and combines with another heat transfer pipe 26 (the second heat transfer pipe) vertically adjacent to the heat transfer pipe 26 in the one end section 21A. Combined one heat transfer pipe 26 extends back and force once between the one end section 21A and the other end section 21B of the indoor heat exchanger 21 in the upstream row (the first row) L1. A three-forked vent 28 that couples the two heat transfer pipe 26*b* in the intermediate row L2 and the heat transfer pipe 26*c* in the upstream row L1 is formed in a shape in which the heat transfer pipe 26*c* is coupled substantially in the middle in the up-down direction of the two heat transfer pipes 26*b*. That is, when viewed from the air current direction F, the heat transfer pipe 26*c* connected to the three-forked vent 28 is located between the two heat transfer pipes 26*b*.

The heat transfer pipe 26 of the indoor heat exchanger 21 is configured as explained above. Therefore, when the indoor heat exchanger 21 functions as a condenser during the heating operation, as indicated by an arrow in FIG. 7, the refrigerant R32 flows into the plurality of heat transfer pipes 26 from the indoor gas side refrigerant distributor 24 and merges through the downstream row L3 and the intermediate row L2. The merged refrigerant flows back and forth once in the upstream row L1 and is discharged to the indoor liquid side refrigerant distributor 25.

Figure 8:
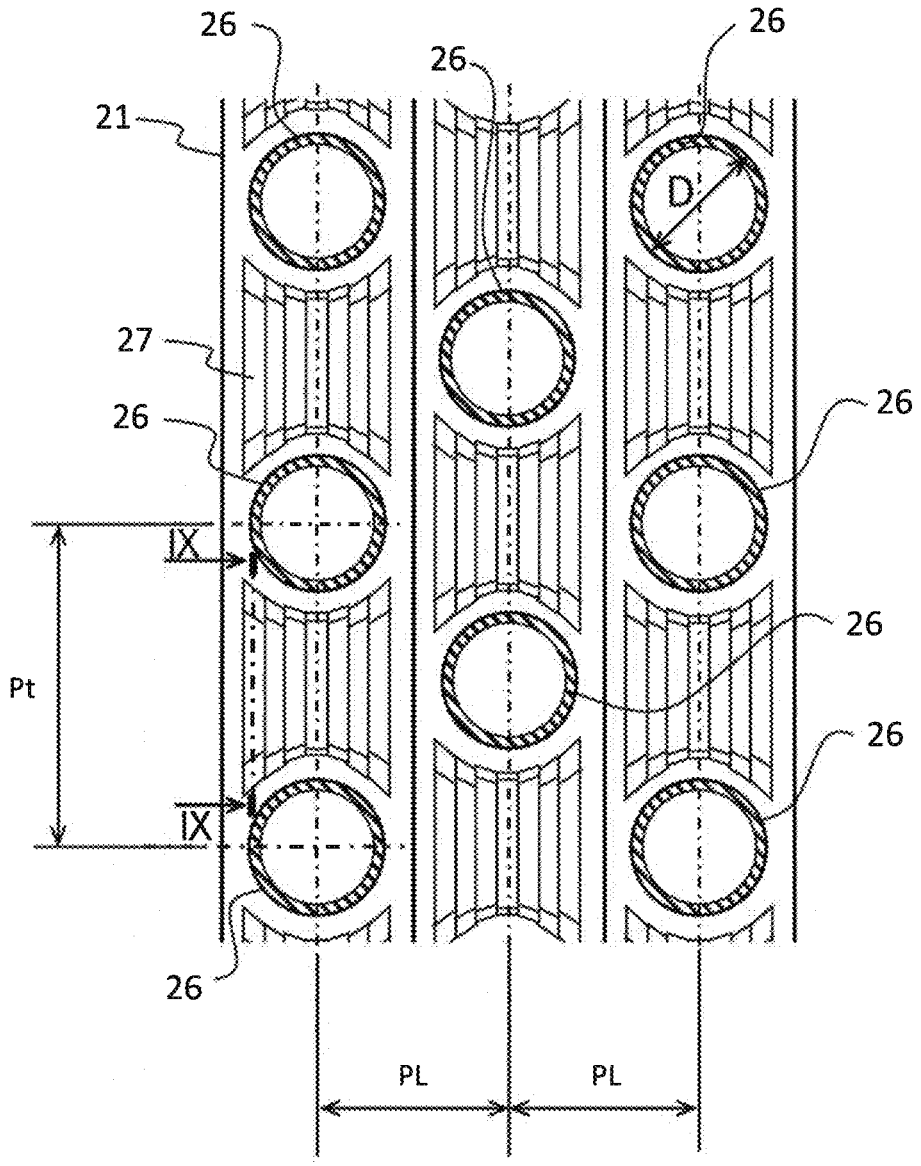
FIG. 8 is a longitudinal sectional view of the indoor heat exchanger.

FIG. 8 shows a longitudinal sectional view of the indoor heat exchanger 21. As shown in FIG. 8, a diameter D of the heat transfer pipe 26 is $4 \leq D \leq 6$ mm. A vertical pitch Pt of the heat transfer pipes 26 vertically adjacent to each other (the distance between the centers of the heat transfer pipes 26) is $11 \leq Pt \leq 17$ mm. A lateral pitch PL of the heat transfer pipes 26 (the distance between straight lines passing the centers of the heat transfer pipes 26 configuring the rows) is $7 \leq PL \leq 11$ mm.

Figure 9:
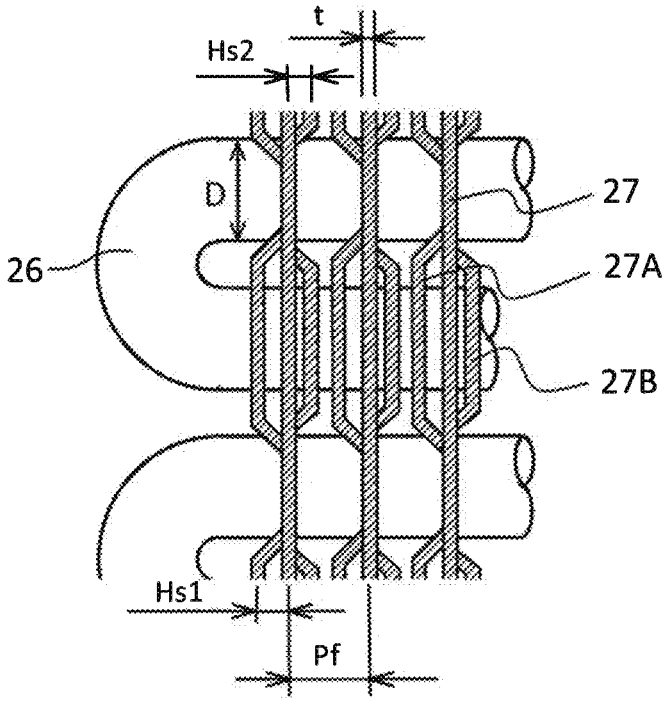
FIG. 9 is a sectional view taken along line IX-IX in FIG. 8.

FIG. 9 is a sectional view taken along line IX-IX in FIG. 8. As shown in FIG. 8, slits 27A and 27B are provided in, the fin 27. Plate thickness t [mm] of the fin. 27 and a pitch Pt [mm] of the fins 27 adjacent to each other are set in a relation of $0.06 \leq t/Pf \leq 0.12$. Slit cut and raise widths Hs1 and Hs2 [mm] are set, for example, in a relation of $1.2 \leq Hs1/Hs2 \leq 1.6$ with slight differences respectively provided with respect to Pf/3 taking into account heat transfer performance and ventilation resistance.

As explained above, the heat transfer pipe 26 extends from the one end section 21A to the other end section 21B of the indoor heat exchanger 21 in the downstream row L3, extends from the other end section 21B to the one end section 21A of the indoor heat exchanger 21 in the intermediate row L2, and combines with another heat transfer pipe 26 vertically adjacent to the heat transfer pipe 26 in the one end section 21A. Combined one heat transfer pipe 26 extends back and force once between the one end section 21A and the other end section 21B of the indoor heat exchanger 21 in the upstream row (the first row) L1.

Therefore, by causing the refrigerant flowing through two heat transfer pipes 26 to merge and flow to one heat transfer pope 26, it is possible to increase a flow rate of the refrigerant and increase a surface heat transfer coefficient.

In this embodiment, since R32 is used as the refrigerant, it is possible to reduce a refrigerant mass flow rate in use. Therefore, even if the refrigerant is caused to merge as explained above, since a refrigerant flow rate is relatively small, it is possible to suppress a pressure loss.

Figure 10:
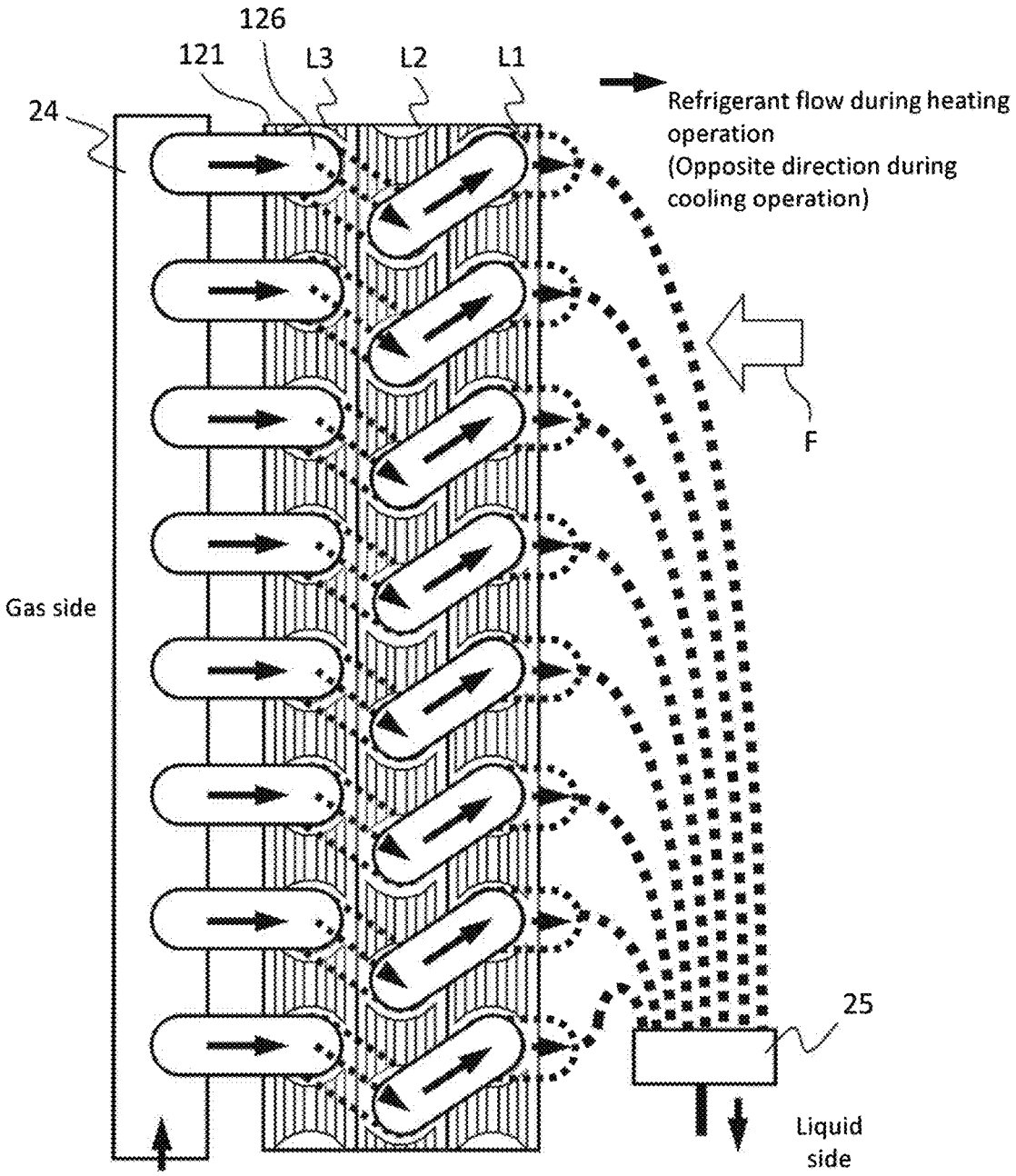
FIG. 10 is a diagram showing the configurations of a heat transfer pipe and a fin of a conventional indoor heat exchanger.

In the configuration of a conventional heat exchanger 121 shown in FIG. 10, heat transfer pipes 126 connected to the indoor gas side refrigerant distributor 24 extend back and force 1.5 times in total in the rows L1 to L3 to be connected to the indoor liquid side refrigerant distributor 25. In this case, when the heat exchanger 121 is used as a condenser, the number of refrigerant channels of a refrigerant flowing out from the indoor gas side refrigerant distributor 24 and the number of refrigerant channels of the refrigerant flowing into the indoor liquid side refrigerant distributor 25 are the same.

Therefore, to reduce the number of refrigerant channels, it is necessary to reduce the number of the heat transfer pipes 126 of the heat exchanger 121. If the number of the heat transfer pipes 126 is reduced, an intra-pipe heat transfer area decreases. This does not lead to improvement of the performance of the heat exchanger 121.

As the refrigerant flows from the downstream row L3 to the intermediate row 12 and the top low L1 according to the progress a condensation process, the density of the refrigerant increases and a refrigerant flow rate in the heat transfer pipe 126 decreases. Consequently, since a surface heat transfer coefficient in the heat transfer pipes 126 is deteriorated, the efficiency of the heat exchanger 121 cannot increased to the maximum.

A relation between an subcooling degree and a COP of the indoor heat exchanger 21 functioning as a condenser during the heating operation in the air conditioner 1, in which R32 is used as the refrigerant, is explained with reference to FIG. 11. A relation between an subcooling degree and a COP of the indoor heat exchanger 21 in the air conditioner 1, in which R410A is used as the refrigerant as comparison with R32, is also shown. It is seen that there are peaks where the COP is the maximum with respect to the subcooling degree both when R410A is used and when R32 is used. The COP of R32 shows a peak P2 when the subcooling degree is smaller than a peak P1 of the COP of R4107.

As indicated by the refrigeration cycle on the Mollier chart of FIG. 2, a reason for the above relates to the fact that R32 has a larger specific enthalpy difference.

A contribution of an outlet of the condenser to the ability of the subcooling degree is an increase of specific enthalpy differences indicated by Δhsc_R410A and Δhsc_R32 in FIG. 2. Since R32 originally has a large specific enthalpy difference in the condenser, an ability increase rate by subcooling Δhsc_R32 tends to be smaller than that of R410A.

It is necessary to increase compression pa through an increase in condensation pressure with respect to an ability increase by an subcooling degree increase. Therefore, there is a point where a COP decrease of R32 is larger than a COP decrease of R410A. Therefore, the COP of R32 during heating is the maximum at a point where the subcooling degree is smaller.

This means that, in the configuration of the indoor heat exchanger 21 in this embodiment shown in FIG. 7, since R32 is used, a special effect can be exhibited. That is, by reducing the subcooling degree at the outlet of the condenser, it is possible to reduce a temperature difference between the heat transfer pipes 26 adjacent to each other in the upstream row L1 in which the liquid refrigerant flows in the indoor heat exchanger 21. That is, it is possible to suppress a heat loss between the adjacent heat transfer pipes 26. It is possible to improve the surface heat transfer coefficient and improve the performance of the indoor heat exchanger 21.

Figure 11:
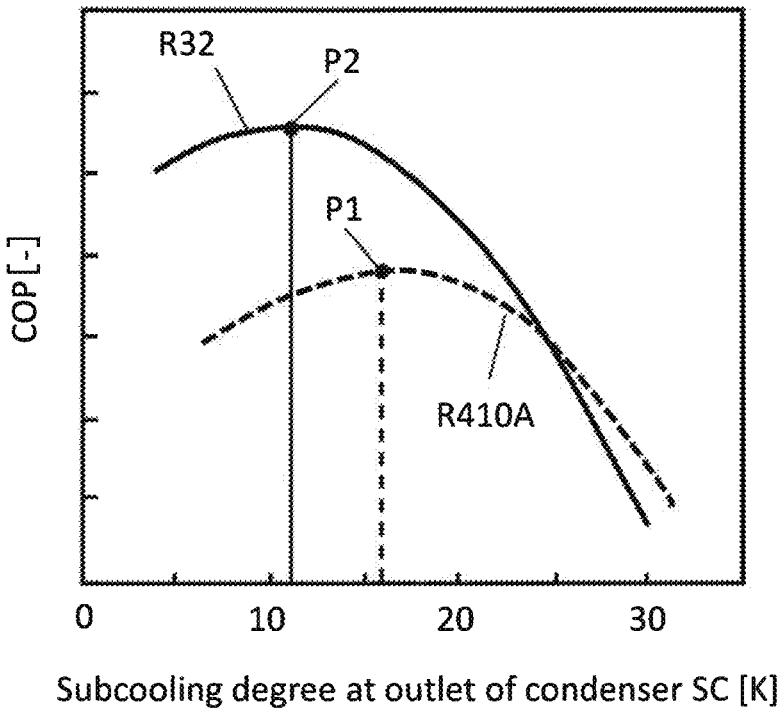
FIG. 11 is a diagram showing a relation between an subcooling degree and a COP of the indoor heat exchanger during a heating operation.

As shown in FIG. 11, a larger COP can be obtained when R32 is used than when R410A is used.

Figure 12:
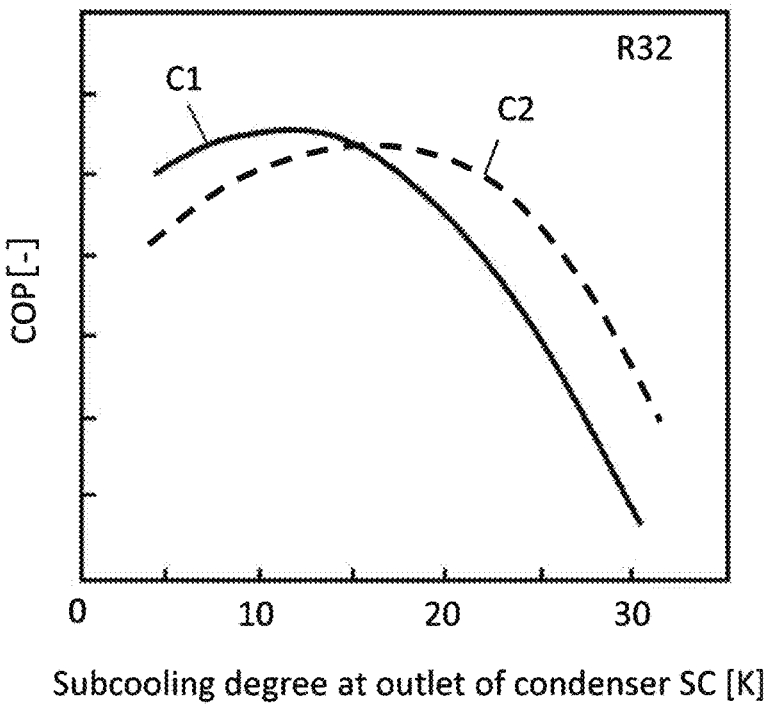
FIG. 12 is a diagram showing the influence of an subcooling degree on a COP during a heating operation in an air conditioner in which R32 is used as a refrigerant.
Figure 13:
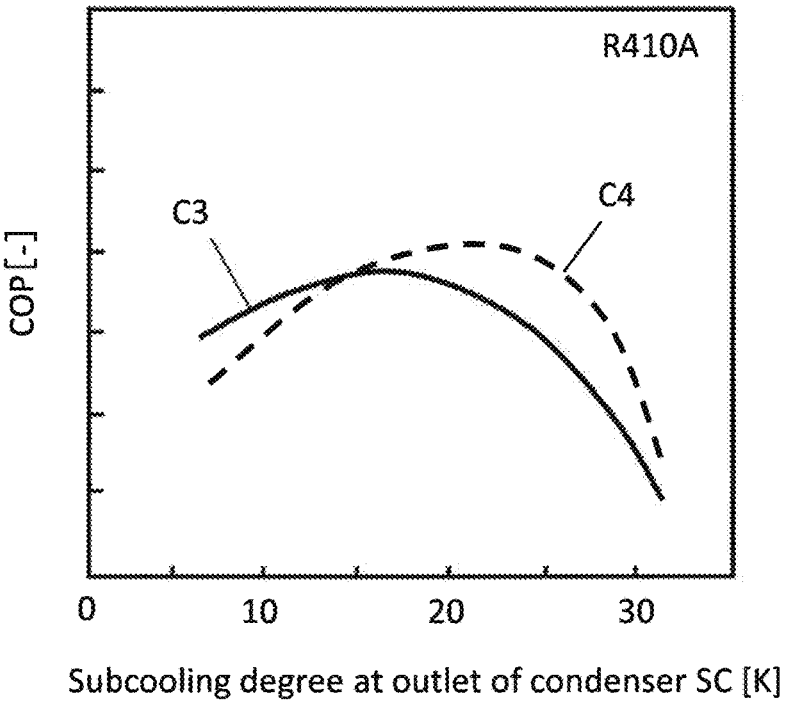
FIG. 13 is a diagram showing the influence of an subcooling degree on a COP during a heating operation in an air conditioner in which R410A is used as a refrigerant.

FIGS. 12 and 13 are results obtained by verifying the effects explained above. In FIG. 12, the influence of an subcooling degree on a COP during the heating operation in the air conditioner, in which R32 is used as the refrigerant, is shown. In FIG. 13, the influence of an subcooling degree on a COP during the heating operation in the air conditioner, in which R410A is used as the refrigerant, is shown. C1 and C3 in FIGS. 12 and 13 indicate the influences of the subcooling degrees on the COPs in the air conditioner 1 including the indoor heat exchanger 21 in this embodiment shown in FIG. 7 in which R32 and R410A are used. C2 and C4 indicate the influences of the subcooling degrees on the COPs in the air conditioner including the indoor heat exchanger 121 shown in FIG. 10 in which R32 and R410A are used.

As shown in FIG. 12, the COP of C1 is higher because of the effects explained above. On the other hand, when R410A is used as the refrigerant in the air conditioner 1 in this embodiment as shown in FIG. 13, performance (COP) is deteriorated as indicated by C3.

Figure 14:
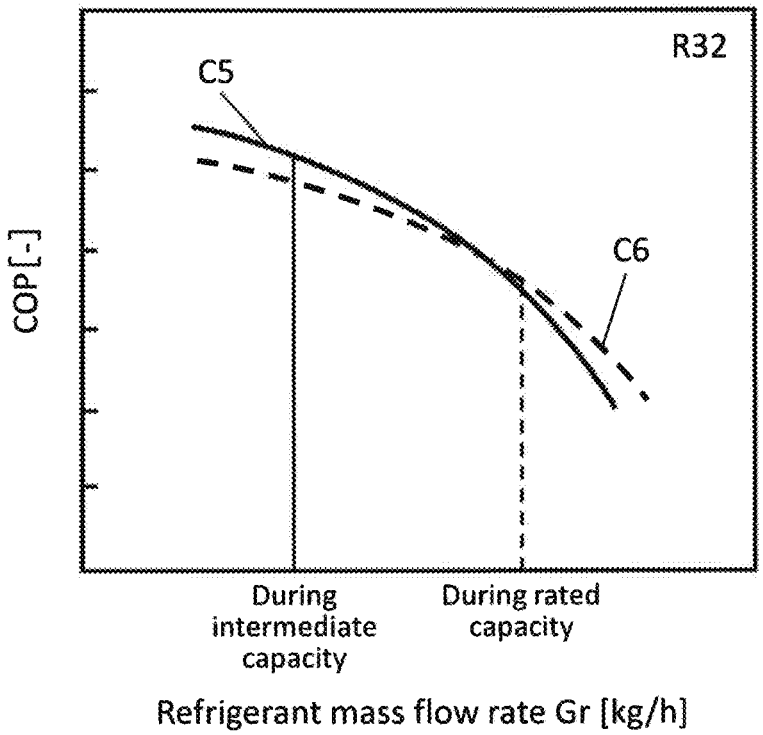
FIG. 14 is a diagram showing the influence of a refrigerant mass flow rate on a COP during a cooling operation in the air conditioner in which R32 is used as the refrigerant.
Figure 15:
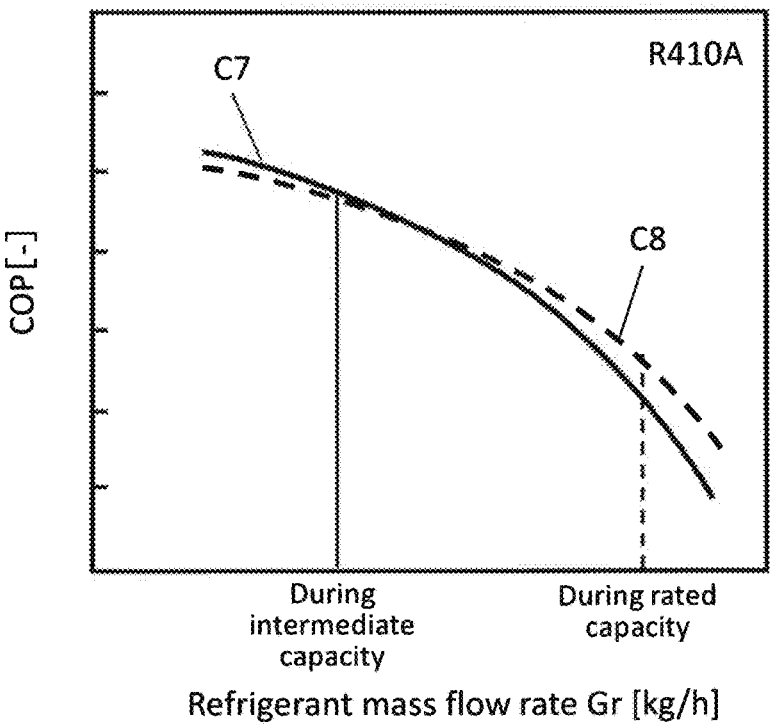
FIG. 15 is a diagram showing the influence of a refrigerant mass flow rate on a COP during a cooling operation in the air conditioner in which R410A is used as the refrigerant.

FIGS. 14 and 15 show the influences of refrigerant mass flow rates on COPs during the cooling operation in the air conditioners in which R32 and R410A are used as the refrigerant. C5 and C7 in FIGS. 14 and 15 indicate the influences of the refrigerant mass flow rates on the COPS in the air conditioner 1 including the indoor heat exchanger 21 in this embodiment shown in FIG. 7 in which R32 and R410A are used. C6 and C8 indicate the influences of the refrigerant mass flow rates on the COPs in the air conditioner including the indoor heat exchanger 121 shown in FIG. 10 in which R32 and R410A are used.

Since there is no influence of a heat loss in the subcooling region during the cooling operation, the influence of a refrigerant flow rate is predominant. Therefore, it is seen that, because of a physical property difference between R410A and R32, the COP is higher, in particular in a cooling intermediate capacity region in C5 and C7 in which R32 and R410A are used in the air conditioner 1 including the indoor heat exchanger 21 in this embodiment.

Figure 16:
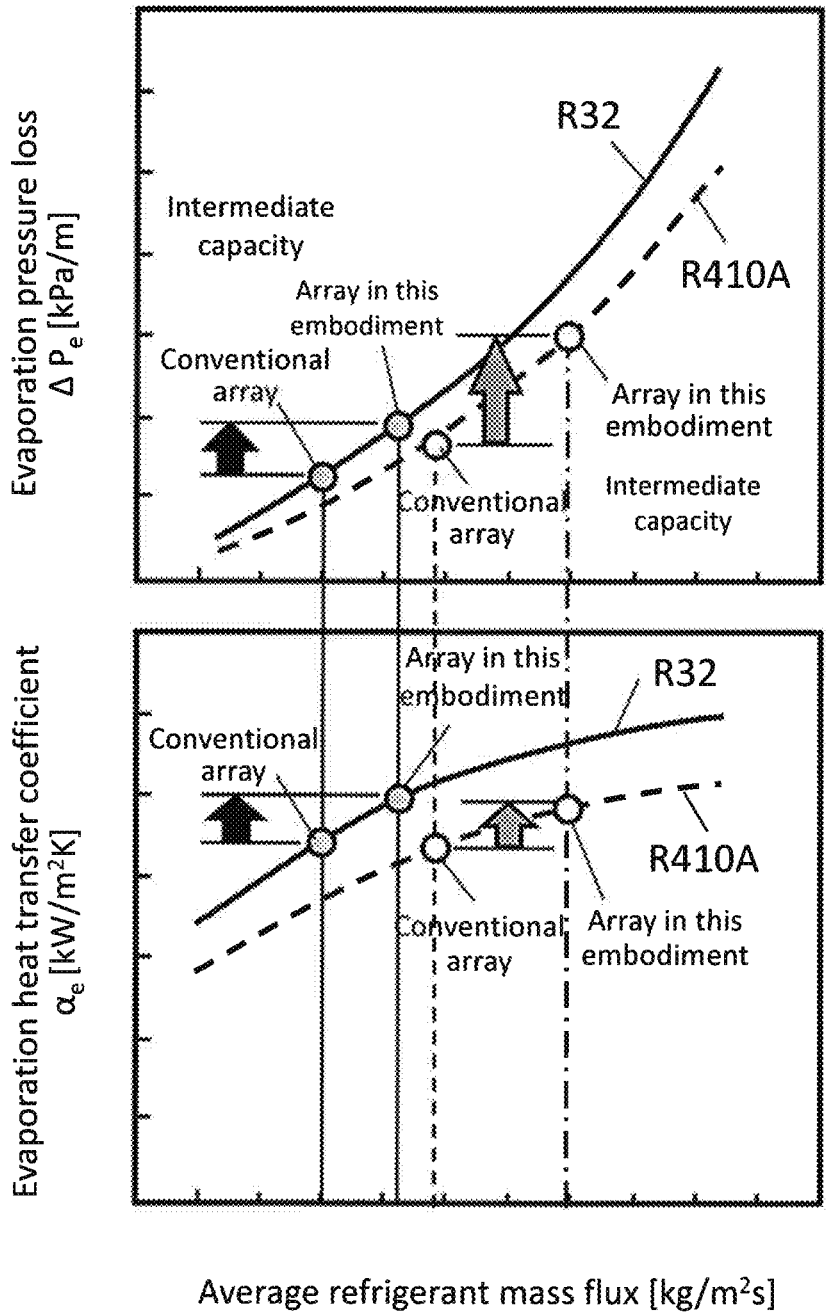
FIG. 16 is a diagram showing a relation between a mass flux, and an intra-pipe heat transfer coefficient and a pressure loss during evaporation.

To explain the above more in detail, a relation between a mass flux and an intra-pipe heat transfer coefficient and a pressure loss during evaporation is shown in FIG. 16. Note that the mass flux, the intra-pipe heat transfer coefficient, and the pressure loss are respectively indicated by averages in the total length.

In FIG. 16, an operation state during a cooling intermediate capacity is shown. The intra-pipe heat transfer coefficient and the pressure loss due to the mass flux during evaporation are indicated by comparison of R32 and R410A. Specifically, in both of R32 and R410A, operation states in an array of the heat transfer pipes 126 in the conventional heat exchanger 121 shown in FIG. 10 (hereinafter referred to as conventional array) and an array of the heat transfer pipes 26 in the heat exchanger 21 in this embodiment shown in FIG. 7 (hereinafter referred to as array in this embodiment) are respectively indicated by points.

When the conventional array is changed to the array in this embodiment in R410A, an increase rate of the heat transfer coefficient is small, although an increase in the pressure loss is large. However, in R32, since the pressure loss at the time when the same ability is generated is small, an increase rate of the pressure loss is small and the increase rate of the heat transfer coefficient is large even when the conventional array is changed to the array in this embodiment. Therefore, this can be considered as more effective for improvement of performance during cooling of R32.

Figure 17:
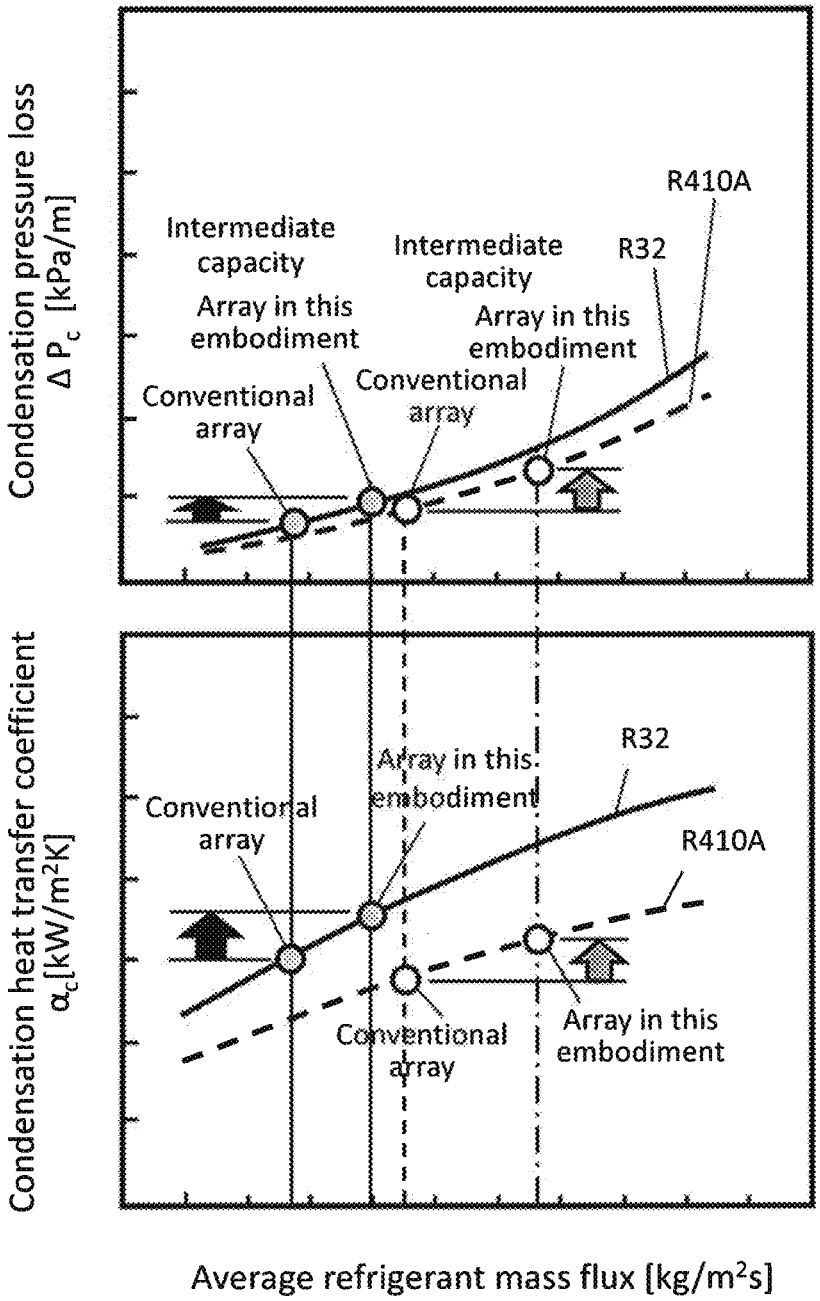
FIG. 17 is a diagram showing a relation between a mass flux and an intra-pipe heat transfer coefficient and pressure loss during condensation.

Note that, in FIG. 17, an intra-pipe heat transfer coefficient and a pressure loss due to a mass flux during condensation are indicated by comparison of R32 and R410A. A degree of influence due to a change in the mass flux during condensation is the same as that during evaporation, although an absolute value is different. That is, the use of the array in this embodiment for R32 can be considered more effective for improvement of performance during heating.

Figure 18:
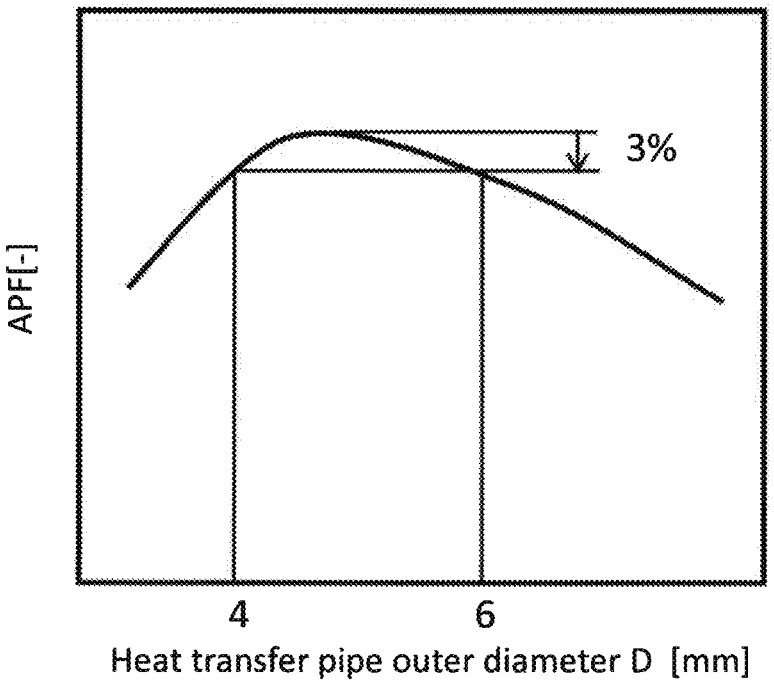
FIG. 18 is an explanatory diagram of the influence of a heat transfer pipe outer diameter on the performance of the air conditioner.

As explained above, the outer diameter D of the heat transfer pipe 26 is $4 \leq D \leq 6$ mm. Therefore, as shown in FIG. 18, since the heat transfer pipe pitches (Pt and PL) can be reduced by suppressing an increase in ventilation resistance, it is possible to improve efficiency—annual performance factor: APF—of the air conditioner 1. That is, it is possible to suppress a fall in the APF from a peak within 3%.

Figure 19:
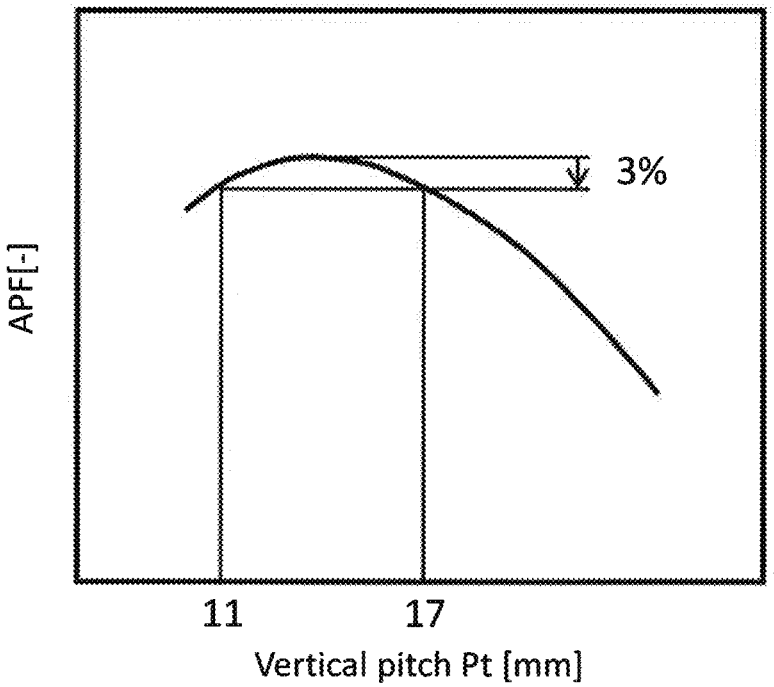
FIG. 19 is an explanatory diagram of the influence of a vertical pitch of a heat transfer pipe of a heat exchanger on the performance of the air conditioner.

The vertical pitch Pt of the heat transfer pipes 26 vertically adjacent to each other is 11≤Pt≤17 mm. In this range, it is possible to improve the efficiency of the air conditioner 1 while reducing the influence of a heat loss due to heat conduction of the fins as shown in FIG. 19.

That is, a loss due to the heat conduction of the fins is larger as the vertical pitch Pt is smaller. In FIG. 19, the influence of the vertical pitch on the APF is shown. When the vertical pitch is equal to or smaller than 11 mm, the APF falls because the influence of heat conduction through the fins increases. Conversely, when the vertical pitch is equal to or larger than 17 mm, an intra-pipe heat transfer area and fin efficiency decrease because of a decrease in the number of mounted heat transfer pipes 26. A fall in the APF occurs. Therefore, it is desirable to set 11 mm≤Pt≤17 mm as a range of the vertical pitch Pt in which a rate of fall within 3% from the peak of the APF can be secured.

Figure 20:
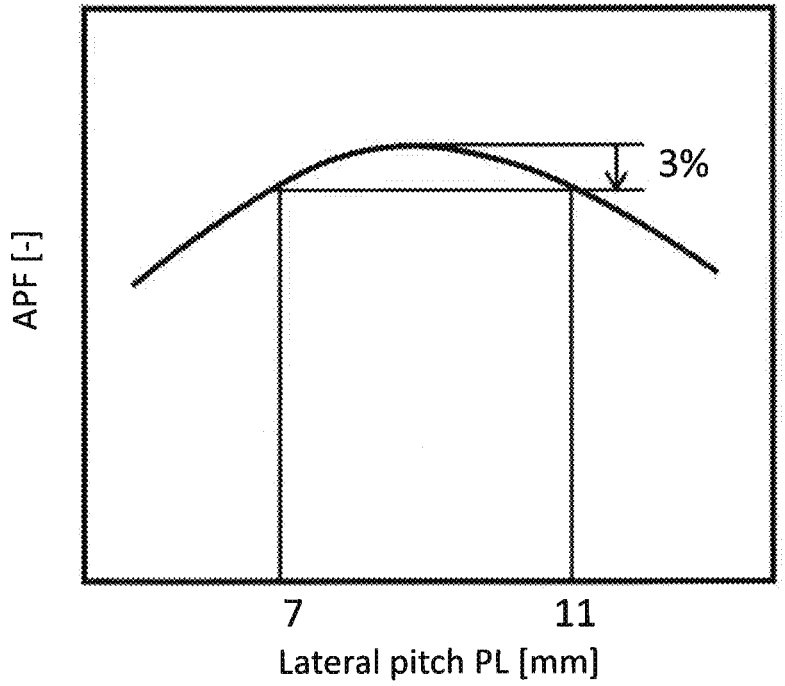
FIG. 20 is an explanatory diagram of the influence of a lateral pitch of the heat transfer pipe of the heat exchanger on the performance of the air conditioner.

The lateral pitch PL of the heat transfer pipes 26 is 7≤PL≤11 mm. Therefore, as shown in FIG. 20, it is possible to optimize a balance between the heat transfer area and the ventilation resistance and improve the efficiency of the air conditioner 1. That is, it is possible to suppress a fall of the APF from the peak within 3%.

Figure 21:
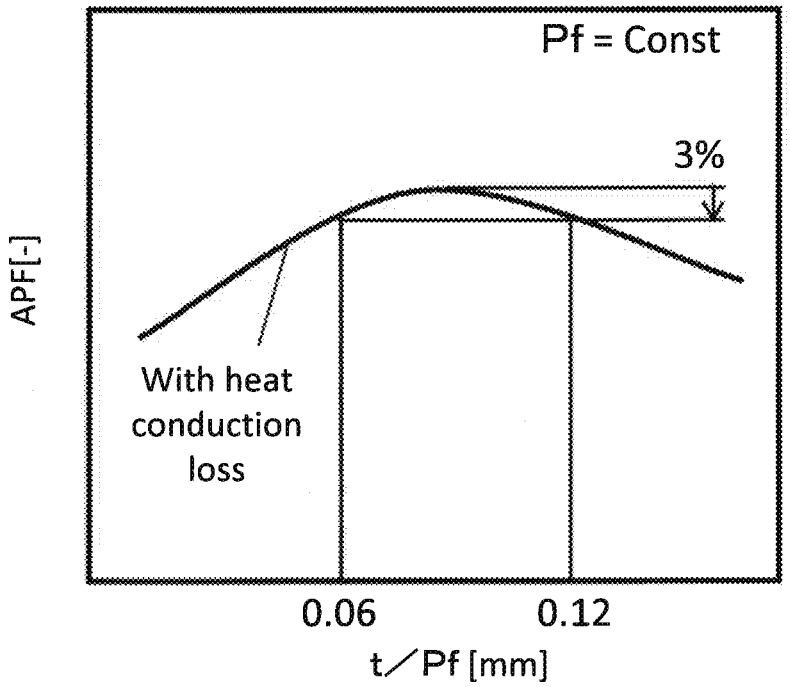
FIG. 21 is an explanatory diagram of fin plate thickness t and a fin pitch Pf of the heat exchanger on the performance of the air conditioner.

A relation between the plate thickness t [mm] and a fin pitch Pf [mm] of the fins 27 is 0.06≤t/Pf≤0.12. Therefore, as shown in FIG. 21, it is possible to increase the APF of the air conditioner 1 while obtaining a reduction effect for a heat loss in the subcooling region as shown in FIG. 21. That is, as the thickness of the fins 27 is larger and the numb of fins is larger, the influence of a heat loss on the adjacent heat transfer pipes 26 due to the heat conduction influence through the fins 27 more easily appears. However, when R32 is used, the heat loss influence is relaxed. When this influence is taken into account, if t/Pt is small when the fin pitch Pt is fixed, performance is deteriorated because of a fall in fin efficiency. If t/Pf is large, the influence of a heat loss is large. Therefore, it is desirable to set 0.06≤t/Pf≤0.12 as a range in which the APF of the air conditioner 1 is performance within 3% from the peak.

Since the slits 27A and 27B are provided in the fin 27, the surface heat transfer coefficient is high and fin efficiency is relatively low. Therefore, it is possible to suppress the influence of heat conduction on the adjacent heat transfer pipes 26.

Note that the present invention is not limited to the embodiments explained above. Those skilled in the art can perform various additions, changes, and the like within the scope of the present invention.

For example, an effect due to a path of the heat transfer pipes 26 of the indoor heat exchanger 21 is particularly large in the ceiling embedded type indoor unit 20 because subcooling region influence in the heating is large and from a relation of a degree of freedom of the array of the heat transfer pipes 26. That is, in the ceiling embedded type indoor unit, the indoor heat exchanger 21 is arranged to substantially entirely surround a blower (the indoor fan 22) as shown in FIGS. 5 and 6. The depth and the height of the indoor heat exchanger 21 are limited. Therefore, improvement of the performance of the indoor heat exchanger 21 by high density arrangement of the heat transfer pipes 26 is effective. In addition to the refrigerant passage in this embodiment with which the mounting space of the refrigerant distributors 24 and 25 can be reduced, by setting the heat transfer pipe diameter, the vertical pitch, and the lateral pitch in the ranges explained above, it is possible to realize the high-performance air conditioner 1 that makes the best use of the characteristics of R32.

However, effects can also be exhibited when the path of the heat transfer pipes 26 is used in other indoor forms and the outdoor unit 10. Forms of uses of the path of the heat transfer pipes 26 are not limited. Therefore, the configuration of the path of the heat transfer pipes 26 may be used in other indoor forms and the outdoor heat exchanger 13 of the outdoor unit 10.

The slits 27A and 27B are provided in the fin 27. However, louvers may be provided. In the embodiment, R32 is used alone as the refrigerant. However, the same effects can be obtained when a mixed refrigerant containing 70 weight or more of R32 is used.

Figure 22:
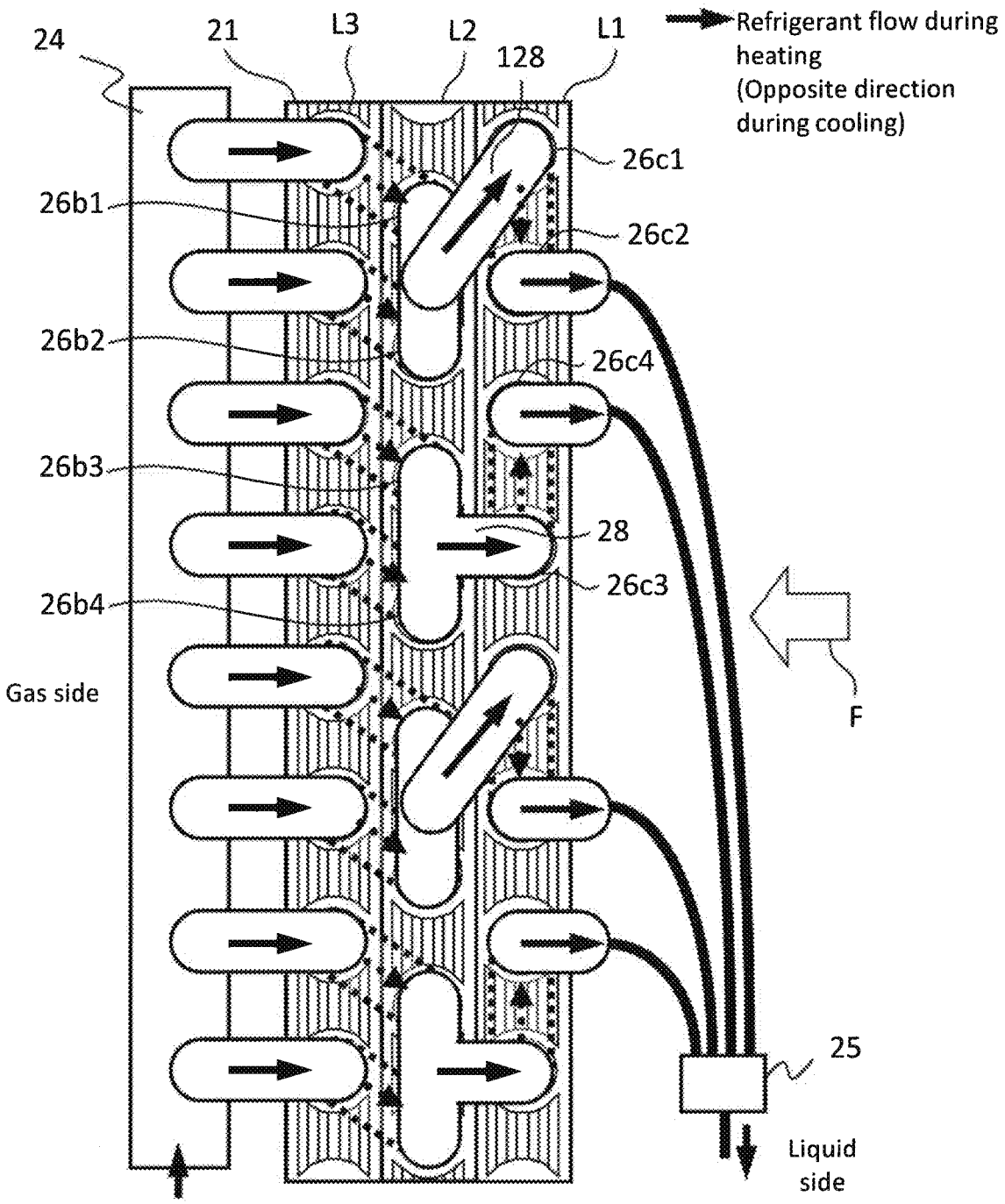
FIG. 22 is a diagram showing a modification of a row configuration of heat transfer pipes of the indoor heat exchanger.
Figure 23:
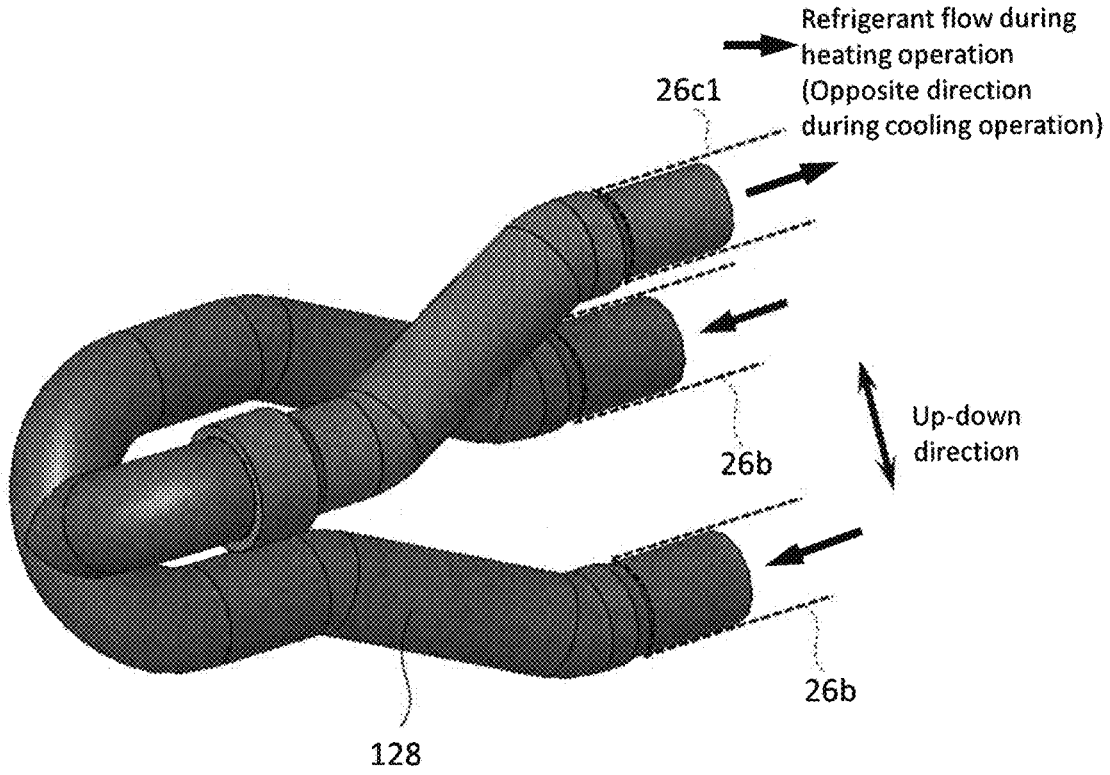
FIG. 23 is an external view showing a three-forked vent.

The row configuration of the heat transfer pipes of the indoor heat exchanger may be a row configuration of the heat transfer pipes 26 shown in FIG. 22. That is, as shown in FIG. 22, two heat transfer pipes **26*b*1 and 26*b*2 in the intermediate row L2 and a heat transfer pipe 26*c*1 in the upstream row L1 located further on the upper side than the heat transfer pipe 26*b*1 may be connected. Two heat transfer pipes 26*b*3 and 26*b*4 adjacent to the two heat transfer pipes 26*b*1 and 26*b*2 and a heat transfer pipe 26*c*3 in the upstream row L1 are connected in the same manner as in the embodiment. A three-forked vent 126 connecting the two heat transfer pipes 26*b*1 and 26*b*2 and the heat transfer pipe 26*c*1 is configured such that, as shown in FIG. 23, a position connected to the heat transfer pipe 26*c*1 in the upstream row L1 is present further on the upper side than a position connected to the two heat transfer pipes 26*b* in the intermediate row L2. The three-forked vent 128** is configured such that the refrigerant collides and diverges in a branching portion during the cooling operation and a gas-liquid two-phase flow is substantially equally distributed.

The heat transfer pipes (first combined pipes) **26*c*1 and 26*c*2, with which the two heat transfer pipes 26*b*1 and 26*b*2 are combined, are arranged such that the heat transfer pipe 26*c*1 extends from the one end section 21A (FIG. 5) to the other end section 21B (FIG. 5) and the heat transfer pipe 26*c*2 extends from the other end section 21B to the one end section 21A on the lower side of the heat transfer pipe 26*c*1. The heat transfer pipes (second combined pipes) 26*c*3 and 26*c*4, with which the two heat transfer pipes 26*b*3 and 26*b*4 are combined, are arranged such that the heat transfer pipe 26*c*3 extends from the one end section 21A (FIG. 5) to the other end section 21B and the heat transfer pipe 26*c*4 extends from the other end section 21B to the one end section 21A on the upper side of the heat transfer pipe 26*c*3. Therefore, the heat transfer pipe 26*b*2 and the heat transfer pipe 26*b*4 extending from the other end section 21B to the one end section 21**A are arranged to be adjacent to each other.

Therefore, in the row configuration of the heat transfer pipe 26 shown in FIG. 22, the heat transfer pipe **26*b*2 and the heat transfer pipe 26*b*4 extending from the other end section 21B to the one end section 21A are arranged to be adjacent to each other. Therefore, since the overcooled refrigerant is vertically continuous, a heat loss is less likely to occur at temperatures close to each other. Consequently, there is an effect of further reducing the heat loss. It is possible to further improve the APF of the air conditioner 1**.

Figure 24:
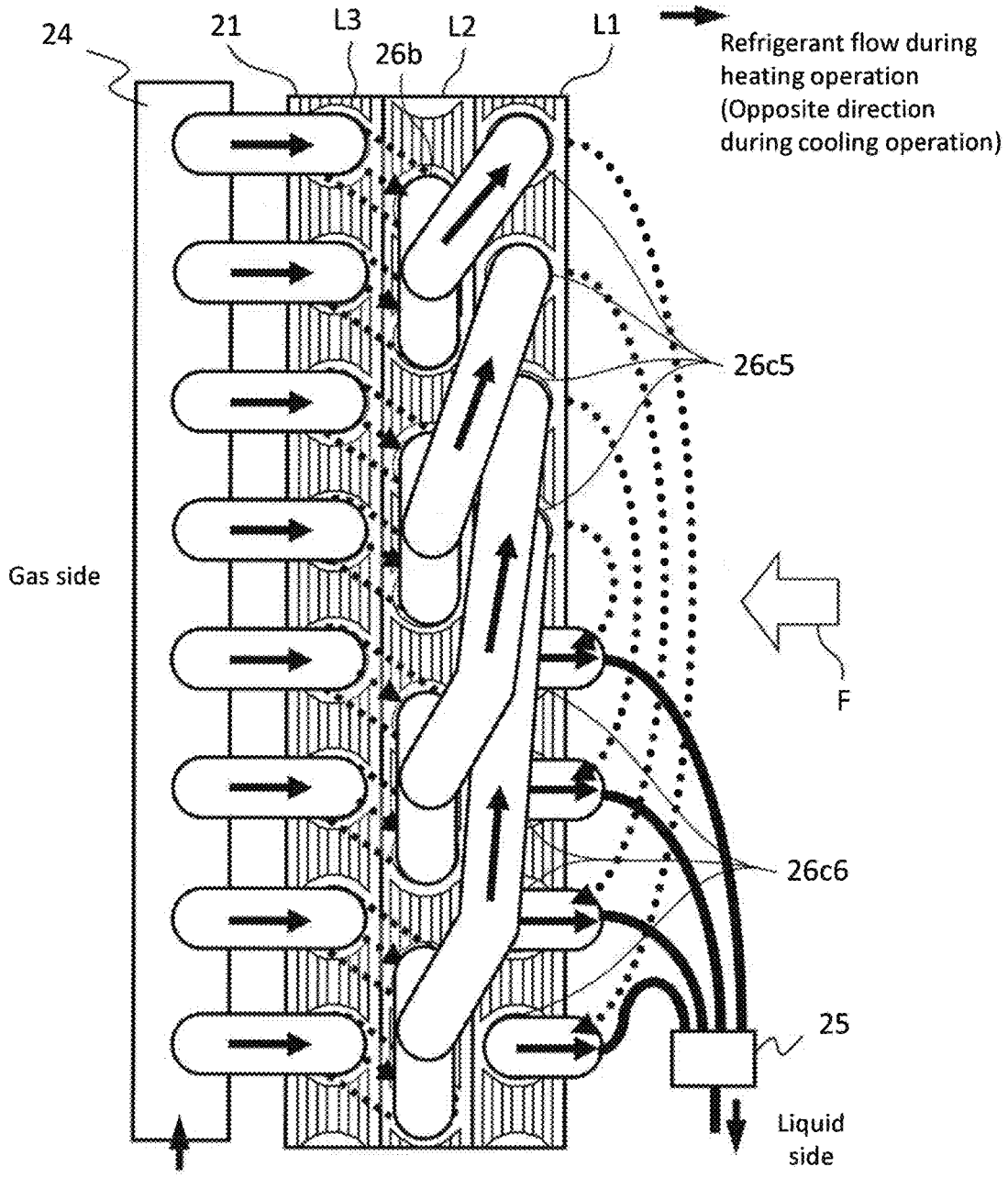
FIG. 24 is a diagram showing another modification of the row configuration of the heat transfer pipes of the indoor heat exchanger.

The row configuration of the heat transfer pipes of the indoor heat exchanger may be a row configuration of the heat transfer pipes 26 shown in FIG. 24. As shown in FIG. 24, in heat transfer pipes **26*c*5 and 26*c*6 with which a plurality of sets of the two heat transfer pipes 26*b* in the intermediate row L2 are respectively combined, the heat transfer pipes 26*c*5 extending from the one end section 21A (FIG. 5) to the other end section 21B (FIG. 5) are collectively arranged on the upper side and the heat transfer pipes 26*c*6 extending from the other end section 21B to the one end section 21A are collectively arranged on the lower side. In other words, the heat transfer pipes 26*c*5 extending from the one end section 21A to the other end section 21B are arranged to be adjacent to one another. The heat transfer pipes 26*c*6 extending from the other end section 21B to the one end section 21**A are arranged to be adjacent to one another.

With this configuration, compared with the row configuration of the heat transfer pipes 26 shown in FIG. 22, it is possible to further reduce a heat loss of the heat transfer pipes 26 adjacent to each other in the up-down direction in the subcooling region when the indoor heat exchanger 21 acts as the condenser. It is possible to provide the indoor heat exchanger 21 having higher efficiency and improve the APF of the air conditioner 1.

Figure 25:
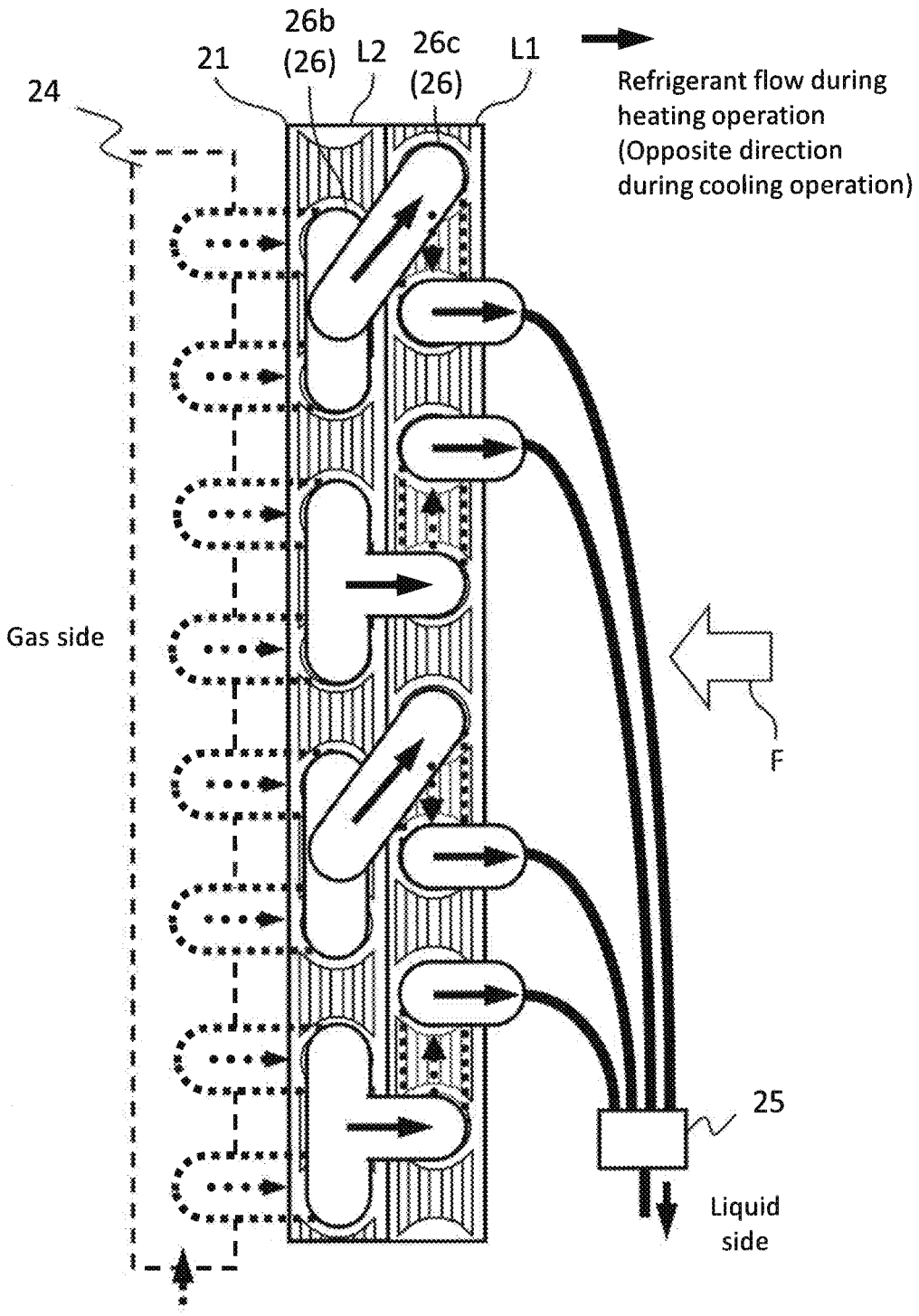
FIG. 25 is a diagram showing a row configuration of the heat transfer pipes of the indoor heat exchanger arranged in two rows.

In the explanation in the embodiment, the row configuration of the heat transfer pipes of the indoor heat exchanger is the three-row configuration. However, as shown in FIG. 25, even with a two-row configuration including only the heat transfer pipes 26*b* and 26*c* in the upstream row (the first row) L1 and the intermediate row (the second row) L2 in the air current direction F, it is possible to exhibit the effects in this embodiment, i.e., a reduction in the influence of a heat loss in the subcooling region in the indoor heat exchanger acting as the condenser and improvement of a heat transfer coefficient due to an increase in a flow rate on the liquid side. That is, the row configuration of the heat transfer pipes of the indoor heat exchanger may be a row configuration including the upstream row L1 and the intermediate row L2 and not including the downstream row L3. In this case, the indoor gas side refrigerant distributor 24 is provided on the other end section 21B of the indoor heat exchanger 21. In the air conditioner having a relatively small ability in two rows, it is possible to optimize a balance between performance and costs.

Figure 26:
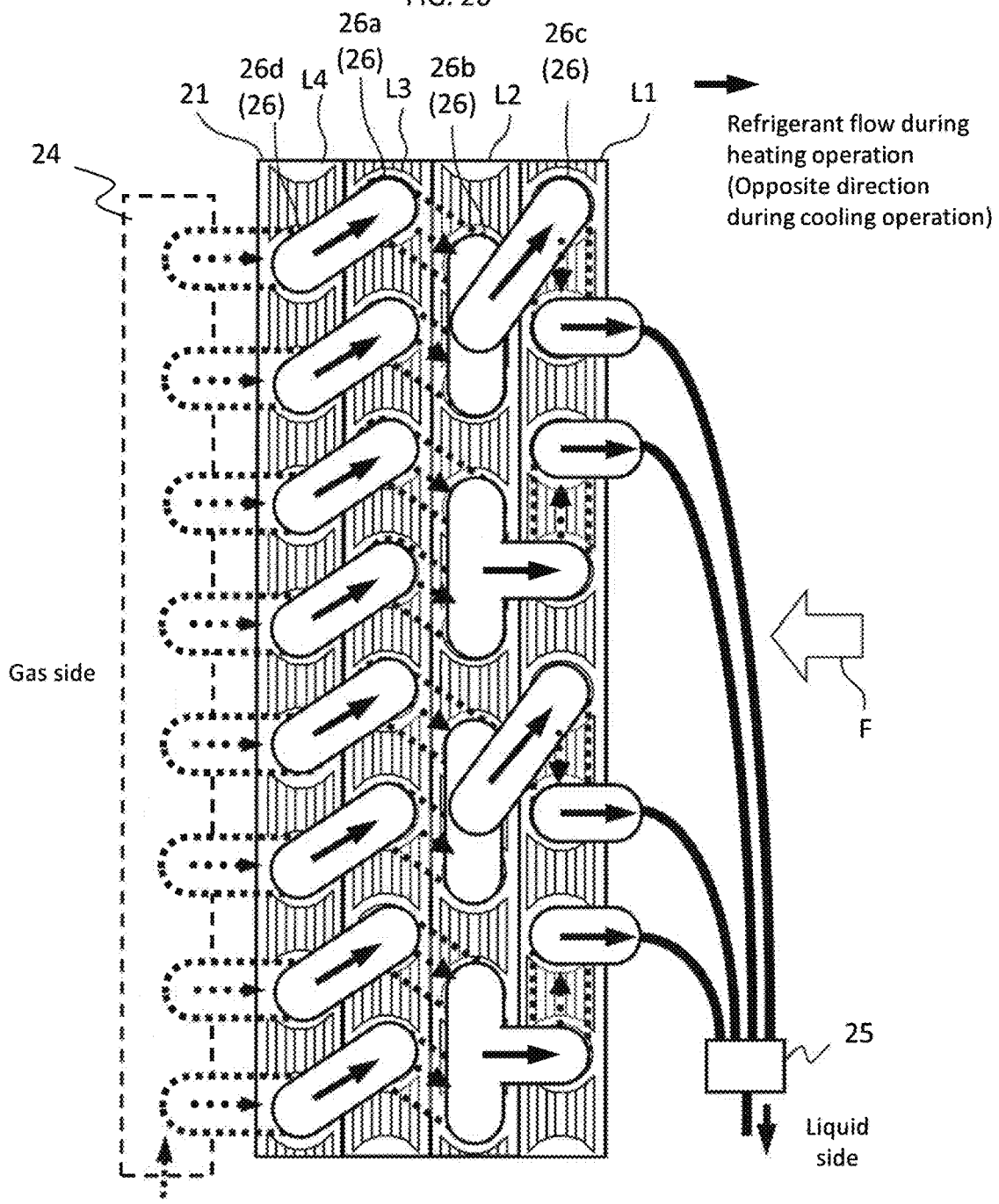
FIG. 26 is a diagram showing a row configuration of the heat transfer pipes of the indoor heat exchanger arranged in four rows.

Further, as shown in FIG. 26, the row configuration of the heat transfer pipes of the indoor heat exchanger may be a four-row configuration. That is, an additional row L4 may be provided further on the downstream side in the air current direction F than the downstream row L3. Heat transfer pipes 26*d* configuring the additional row L4 are respectively connected to the indoor liquid side refrigerant distributor 25, extend from the other end section 21B to the one end section 21A of the indoor heat exchanger 21 in the additional row L4, and are connected to the heat transfer pipes 26*a* configuring the downstream row L3 in the one end section 21A. With such a configuration, it is also possible to exhibit the effects in this embodiment, i.e., a reduction in the influence of a heat loss in the subcooling region in the indoor heat exchanger acting as the condenser and improvement of a heat transfer coefficient due to an increase in a flow rate on the liquid side. Note that, in a configuration of the heat transfer pipe 26 having four or more rows, since a heat transfer area can be increased, it is possible to realize further improvement of performance.

What is claimed is:

1. An air conditioner comprising:

a heat exchanger that includes a plurality of heat transfer pipes, through which a refrigerant flows, and performs heat exchange with air, wherein the heat exchanger includes one end section and the other end section, the plurality of heat transfer pipes are disposed to extend back and forth between the one end section and the other end section in a state in which the heat transfer pipes are arranged in a direction crossing a direction in which the air flows, and rows of the plurality of heat transfer pipes arranged in the crossing direction are configured to be arranged in at least two rows along the direction in which the air flows;

the two rows include a first row located most upstream in the direction in which the air flows and a second row located adjacent to the first row in the direction in which the air flows, the plurality of heat transfer pipes include a first heat transfer pipe and a second heat transfer pipe adjacent to each other in the second row, the first heat transfer pipe and the second heat transfer pipe extend from the other end section to the one end section in the second row and are combined in the one end section to be a first combined pipe, and the first combined pipe is configured to extend back and forth once between the one end section and the other end section in the first row, the plurality of heat transfer pipes further include a third heat transfer pipe and a fourth heat transfer pipe adjacent to each other in the second row, the third heat transfer pipe and the forth heat transfer pipe are arranged to be adjacent to the first heat transfer pipe and the second heat transfer pipe and respectively extend from the other end section to the one end section in the second row, and are combined in the one end section to be a second combined pipe, and the second combined pipe is configured to extend back and forth between the one end section and the other end section in the first row, a portion extending from the other end section to the one end section in the first combined pipe and a portion extending from the other end section to the one end section in the second combined pipe are arranged to be adjacent to each other, the first heat transfer pipe and the second heat transfer pipe, and the first combined pipe are connected by a three-forked vent, the three-forked vent includes a pipe portion connected to the first combined pipe, a pipe portion connected to the first heat transfer pipe, and a pipe portion connected to the second heat transfer pipe, and the pipe portion connected to the first combined pipe includes a portion perpendicularly connected to a combined portion of the pipe portion connected to the first heat transfer pipe and the pipe portion connected to the second heat transfer pipe and a portion extending obliquely upward from the portion perpendicularly connected to the combined portion.

2. An air conditioner comprising:

a heat exchanger that includes a plurality of heat transfer pipes, through which a refrigerant flows, and performs heat exchange with air, wherein the heat exchanger includes one end section and the other end section, the plurality of heat transfer pipes are disposed to extend back and forth between the one end section and the other end section in a state in which the heat transfer pipes are arranged in a direction crossing a direction in which the air flows, and rows of the plurality of heat transfer pipes arranged in the crossing direction are configured to be arranged in at least two rows along the direction in which the air flows;

the two rows include a first row located most upstream in the direction in which the air flows and a second row located adjacent to the first row in the direction in which the air flows, the plurality of heat transfer pipes include a first heat transfer pipe and a second heat transfer pipe adjacent to each other in the second row, the first heat transfer pipe and the second heat transfer pipe extend from the other end section to the one end section in the second row and are combined in the one end section to be a first combined pipe, and the first combined pipe is configured to extend back and forth once between the one end section and the other end section in the first row, the plurality of heat transfer pipes further include a third heat transfer pipe and a fourth heat transfer pipe adjacent to each other in the second row, the third heat transfer pipe and the forth heat transfer pipe are arranged to be adjacent to the first heat transfer pipe and the second heat transfer pipe and respectively extend from the other end section to the one end section in the second row, and are combined in the one end section to be a second combined pipe, and the second combined pipe is configured to extend back and forth between the one end section and the other end section in the first row, a portion extending from the other end section to the one end section in the first combined pipe and a portion extending from the other end section to the one end section in the second combined pipe are arranged to be adjacent to each other, and a portion extending from the one end section to the other end section in the first combined pipe and a portion extending from the one end section to the other end section in the second combined pipe are arranged to be adjacent to each other.

3. The air conditioner according to claim 1, wherein the refrigerant is R32 or a refrigerant containing 70 wt. % or more of R32.

4. The air conditioner according to claim 1, further comprising an indoor unit of a ceiling embedded cassette type, wherein the heat exchanger is used in the indoor unit.

5. The air conditioner according to claim 1, wherein a distance between centers of the heat transfer pipes adjacent to each other in the crossing direction in the rows is equal to or larger than 11 mm and equal to or smaller than 17 mm.

6. The air conditioner according to claim 1, wherein a distance between straight lines passing through centers of the heat transfer pipes configuring the rows is equal to or larger than 7 mm and equal to or smaller than 11 mm.

7. The air conditioner according to claim 1, wherein the heat exchanger includes a plurality of fins attached around the plurality of heat transfer pipes, and slits or louvers are provided in the fins, respectively.

8. The air conditioner according to claim 1, wherein the heat exchanger includes a plurality of fins attached around the plurality of heat transfer pipes, and the plurality of fins are tabular and, when plate a thickness of the fins is represented by t [mm] and an interval of the fins adjacent to each other is represented by pf [mm], $0.06 \leq t/pf \leq 0.12$ is established.

9. The air conditioner according to claim 1, wherein the rows of the plurality of heat transfer pipes include a third row adjacent to the second row on a downwind side in the direction in which the air flows, and the first heat transfer pipe, the second heat transfer pipe, and the third heat transfer pipe, and the fourth heat transfer pipe extend from the one end section to the other end section in the third row and extend from the other end section to the one end section in the second row.

* * * * *